US011118429B2

(12) United States Patent
Wiedecke et al.

(10) Patent No.: US 11,118,429 B2
(45) **Date of Patent: *Sep. 14, 2021**

(54) CONTROL SYSTEM FOR HYDROCARBON RECOVERY TOOLS

(71) Applicant: Weatherford Technology Holdings, LLC, Houston, TX (US)

(72) Inventors: Michael Wiedecke, Salzhemmendorf (DE); Bjoern Thiemann, Burgwedel (DE); Carlo Hoelterling, Bad Schwartau (DE); Frank Wern, Hannover (DE)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 46 days.

This patent is subject to a terminal disclaimer.

(21) Appl. No.: 16/531,372

(22) Filed: Aug. 5, 2019

(65) Prior Publication Data

US 2020/0024931 A1 Jan. 23, 2020

Related U.S. Application Data

(63) Continuation of application No. 15/804,690, filed on Nov. 6, 2017, now Pat. No. 10,480,291.

(51) Int. Cl.
*E21B 19/16* (2006.01)
*H05K 5/02* (2006.01)
(Continued)

(52) U.S. Cl.
CPC ..... *E21B 41/0092* (2013.01); *E21B 19/00* (2013.01); *E21B 19/161* (2013.01);
(Continued)

(58) Field of Classification Search
CPC ..... E21B 19/00; E21B 19/16; E21B 19/165; H05K 5/02; H05K 5/04; G06F 1/181; G06F 1/182
See application file for complete search history.

(56) References Cited

U.S. PATENT DOCUMENTS 4,592,125 A 6/1986 Skene
4,738,145 A 4/1988 Vincent et al.
(Continued)

FOREIGN PATENT DOCUMENTS

WO 8909486 A1 10/1989
WO 2009039448 A2 3/2009

OTHER PUBLICATIONS

European Search Report in related application 18202911.6 dated May 29, 2020.

(Continued)

*Primary Examiner* — Kenneth L Thompson
(74) *Attorney, Agent, or Firm* — Patterson + Sheridan, LLP

(57) ABSTRACT

Methods and systems for controlling a set of tools for hydrocarbon recovery are presented. One example system generally includes a first tool and a first control device mounted on the first tool and configured to operate the first tool. The first control device includes an explosion-proof housing and a processor disposed in the housing. The system further includes a second tool and a second control device mounted on the second tool and configured to operate the second tool. The second control device includes an explosion-proof housing and a processor disposed in the housing.

21 Claims, 15 Drawing Sheets

(51) Int. Cl.
*E21B 41/00* (2006.01)
*E21B 44/00* (2006.01)
*E21B 19/00* (2006.01)

(52) U.S. Cl.
CPC ..... *E21B 19/165* (2013.01); *E21B 41/00* (2013.01); *E21B 44/00* (2013.01)

(56) References Cited

U.S. PATENT DOCUMENTS

| | | | | |
|---|---|---|---|---|
| 4,802,502 | A | 2/1989 | Williams | |
| 4,916,617 | A | 4/1990 | Norwood | |
| 5,245,265 | A | 9/1993 | Clay | |
| 5,691,712 | A | 11/1997 | Meek et al. | |
| 5,988,299 | A | 11/1999 | Hansen et al. | |
| 8,280,639 | B2 | 10/2012 | Conquergood et al. | |
| 8,726,743 | B2 | 5/2014 | Ruehmann et al. | |
| 8,733,213 | B2 | 5/2014 | Taggart | |
| 8,821,622 | B2 | 9/2014 | Manahan et al. | |
| 9,060,442 | B2 * | 6/2015 | Goedknegt | H05K 7/1467 |
| 9,458,683 | B2 | 10/2016 | Yorga et al. | |
| 9,551,195 | B1 | 1/2017 | Baryam | |
| 9,766,364 | B2 | 9/2017 | Hickman | |
| 10,480,291 | B2 * | 11/2019 | Wiedecke | E21B 19/00 |
| 10,480,766 | B2 * | 11/2019 | Taylor | H05K 5/04 |
| 2002/0135989 | A1 | 9/2002 | Preston et al. | |
| 2004/0144547 | A1 | 7/2004 | Koithan et al. | |
| 2005/0096846 | A1 | 5/2005 | Koithan et al. | |
| 2006/0067705 | A1 | 3/2006 | Paulsen | |
| 2007/0005159 | A1 | 1/2007 | Borah et al. | |
| 2007/0107912 | A1 | 5/2007 | Boutwell et al. | |
| 2009/0166034 | A1 | 7/2009 | Mundell | |
| 2009/0217788 | A1 | 9/2009 | Hunter | |
| 2010/0132180 | A1 | 6/2010 | Conquergood et al. | |
| 2011/0127044 | A1 | 6/2011 | Radford et al. | |
| 2011/0187554 | A1 | 8/2011 | Rioufol et al. | |
| 2014/0104074 | A1 | 4/2014 | Hickman | |
| 2015/0107850 | A1 | 4/2015 | Mosing et al. | |
| 2016/0076356 | A1 | 3/2016 | Krems et al. | |
| 2017/0016287 | A1 | 1/2017 | Dion | |
| 2017/0092405 | A1 | 3/2017 | Manahan et al. | |
| 2017/0096864 | A1 | 4/2017 | Blair et al. | |
| 2017/0347473 | A1 * | 11/2017 | Freer | B01D 53/0454 |
| 2017/0370151 | A1 | 12/2017 | Banirazi-Motlagh et al. | |
| 2020/0186182 | A1 * | 6/2020 | Ota | G08C 17/02 |
| 2020/0291751 | A1 * | 9/2020 | Wiedecke | E21B 19/00 |

OTHER PUBLICATIONS

Australian Examination Report in related application AU2018256478 dated Sep. 13, 2019.
International Search Report in related applicaiton PCT/US2017/062315 dated Aug. 28, 2018. 11 Pages.
International Search Report dated Feb. 7, 2018, corresponding to Application No. PCT/US2017/057994.
EPO Extended European Search Report dated Dec. 5, 2018, for European Application No. 18202911.6.
Office Action in related U.S. Appl. No. 15/804,671 dated Apr. 18, 2019.
PCT International Search Report and Written Opinion dated Nov. 16, 2018, for International Application No. PCT/US2017/062315.
Examination Report in related application AU2018256478 dated Jun. 28, 2019.
Australian Examination Report in related application AU2019219739 dated Jun. 15, 2020.
Australian Office Action in relation application AU2019219739 dated Apr. 28, 2021.

* cited by examiner

CONTROL SYSTEM FOR HYDROCARBON RECOVERY TOOLS

CROSS-REFERENCE TO RELATED APPLICATIONS

This Application is a Continuation of application Ser. No. 15/804,690 filed on Nov. 6, 2017. The aforementioned application is herein incorporated by reference.

BACKGROUND OF THE INVENTION

Field of the Invention

The present disclosure generally relates to hydrocarbon recovery tools, and, more specifically, to automated control systems for hydrocarbon recovery tools.

Description of the Related Art

Construction of oil or gas wells usually requires making long tubular strings that make up casing, risers, drill pipe, or other tubing. Due to the length of these strings, sections or joints of tubulars are progressively added to or removed from the tubular strings as they are lowered or raised from a drilling platform. Tongs are devices used on oil and gas rigs for gripping and/or rotating tubular members, such as casing, drill pipe, drill collars, and coiled tubing (herein referred to collectively as tubulars and/or tubular strings). Tongs may be used to make-up or break-out threaded joints between tubulars. Tongs typically resemble large wrenches, and may sometimes be referred to as power tongs, torque wrenches, spinning wrenches, and/or iron roughnecks. Tongs typically use hydraulic power to provide sufficiently high torque to make-up or break-out threaded joints between tubulars.

A drilling rig is constructed on the earth's surface or floated on water to facilitate the insertion and removal of tubular strings (e.g., drill pipe, casing, sucker rod, riser, or production tubing) into a wellbore. The drilling rig includes a platform and power tools, such as an elevator and slips, to engage, assemble, and lower the tubulars into the wellbore. The elevator is suspended above the platform by a draw works that can raise or lower the elevator in relation to the floor of the rig. The slips are mounted in the platform floor. The elevator and slips are each capable of engaging and releasing a tubular and are designed to work in tandem. Generally, the slips hold a tubular or tubular string that extends into the wellbore from the platform. The elevator engages a tubular joint and aligns it over the tubular string being held by the slips. One or more power drives, e.g. a power tong and a spinner, are then used to thread the joint and the string together. Once the tubulars are joined, the slips disengage the tubular string and the elevator lowers the tubular string through the slips until the elevator and slips are at a predetermined distance from each other. The slips then reengage the tubular string and the elevator disengages the string and repeats the process. This sequence applies to assembling tubulars for the purpose of drilling, deploying casing, or deploying other components into the wellbore. The sequence is reversed to disassemble the tubular string.

Drilling tools, such as tongs, overdrive systems, elevators, positioning systems, mud buckets, and other tools used in oilfield operations, can be controlled by dedicated remote control panels. These control panels can be located, for example, in a rig control cabin or in locations accessible by equipment operators in control of a particular tool. Whether located in a control cabin or in various locations on the rig, the controllers may be connected to the drilling tools via a wired or wireless connection.

Different types of drilling tools may operate with different parameters. For example, a tongs system—which may be used to make or break drill pipes by torqueing two lengths of pipe together or breaking a connection between two tubulars—may operate using parameters such as an amount of torque to apply and a direction of rotation and may be commanded to clamp or release a tubular. Positioning devices may operate using parameters such as a horizontal, vertical, and/or azimuthal deflection from a reference point (e.g., positioning on the x, y, and z axes).

A controller may be connected to (e.g., hardwired to) a specific device and be configured to operate only the device to which the controller is connected or otherwise associated with. Multiple controllers may be employed to operate the variety of drilling tools used in well-drilling operations. The remote controllers may be associated with one or more tool controllers. Each of these remote controllers may be customized to control parameters used for the specific tool. The parameters for the specific tool may be associated with a particular input/output device of the remote controller. If a new tool is added to a rig, the software of the both the remote controller and the tool controller associated with the new tool is typically updated in order to support the new tool. In existing control systems, calibration certificates are sent along with the tool. The controller is calibrated at the rig and calibration is performed separately for the tool sensors and the control system inputs. Existing control systems may not have sufficient amounts and/or types of input/output capabilities for newer tool models. Calibration of tool sensors and control system inputs for the new tools can be costly and inefficient. Existing control systems may lack sufficient electronic, hydraulic, pneumatic, data, and/or signal connections for newer tool models.

Existing controllers limit improvements on tongs and other tools because the hardware interface of the tools must be backwards compatible with the existing control systems and their associated input/output devices. Onboard control systems for drilling tools may provide greater reliability and efficiency by allowing for greater flexibility in calibration of tool sensors and control system inputs and modification of the control system software interface. Integrating the control system and input/output device with the drilling tool ensures that the correct amount and/or type of input/output is provided for each drilling tool. Onboard control systems of a tong may provide improved handling, greater reliability, and increased safety and efficiency.

SUMMARY OF THE INVENTION

The present disclosure generally relates to makeup tools, and, more specifically, automated control systems for makeup tools.

One embodiment of the present invention is a hydrocarbon recovery system. The system generally includes a first tool, a remote controller, and a first control device mounted on the first tool and communicatively coupled to the remote controller. The first control device may be configured to receive a command to operate the first tool from the remote controller; based on the command, generate one or more instructions executable by the first control device; and execute the one or more instructions to operate the first tool.

Another embodiment of the present invention is a method for hydrocarbon recovery. The method generally includes receiving, at a first control device mounted to a first tool, one or more commands related to operation of a first tool; based on the received command, generating one or more commands executable by the first control device; and executing the one or more commands to operate the first tool.

Another embodiment of the present invention is a non-transitory computer readable medium including instructions, that when executed by one or more processors, executes a method for hydrocarbon recovery, the method including: receiving, at a first control device mounted on a first tool, one or more commands related to operation of the first tool; based on the received command, generating one or more commands executable by the first control device; and executing the one or more commands to operate the first tool.

Another embodiment of the present invention is a hydrocarbon recovery system. The system generally includes a first tool, a first control device mounted on the first tool and configured to operate the first tool. The first control device generally includes an explosion-proof housing and a processor disposed in the housing.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1A:
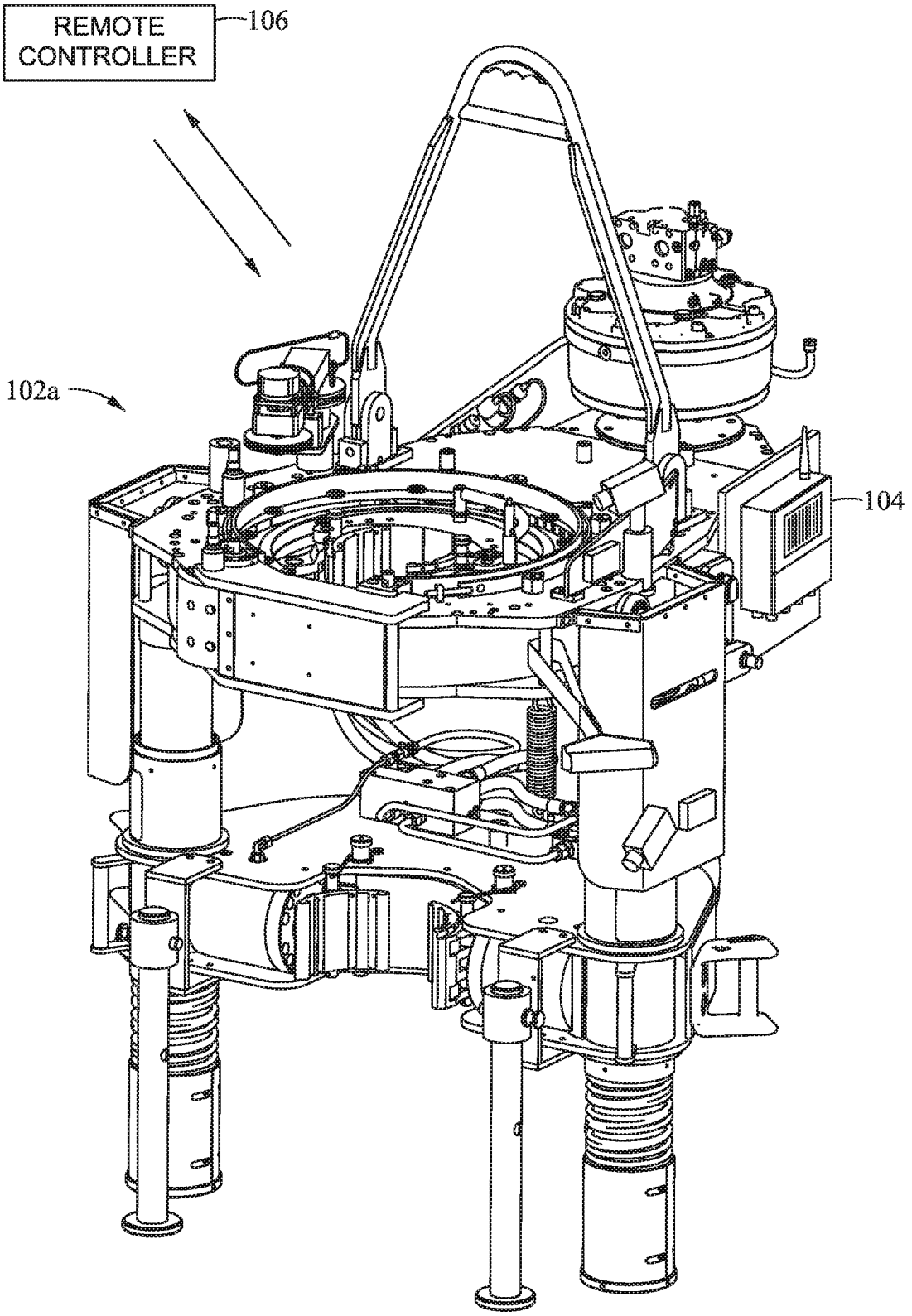
FIG. 1A illustrates an exemplary tool control system, in accordance with embodiments of the present invention.

Embodiments of the present invention generally relate to systems and methods for local control and/or electric power generation for a tong.

In some embodiments, a tong control system may be small (e.g., less than about 2 ft. in any dimension; for example 16"×16"×6"), so that in can be placed on the tong. In some embodiments, data communication between the local tong control system and remote logging/monitoring equipment may be wireless. In some embodiments, electric power generation may occur locally on the tong by branching off a portion of an existing hydraulic supply line. Consequently, existing tongs may be beneficially retrofitted. Some embodiments may provide beneficial reduction in electrical connectors, supply boxes, and/or cables that could be damaged, cause accident or injury, contamination, and/or corrosion issues. There may be beneficially only a few required components (e.g., a hydraulic motor, a volume control valve, an alternator, and a belt or drive shaft to connect both.) In some embodiments, a battery system may power the tong control system during the absence of hydraulic power in the event of an emergency shut-down.

A tong control system may monitor and actuate several parts of the tong. For example, the tong control system may monitor and actuate components of the tong to provide varying torque and/or angular displacement. Disconnection of a tubular joint may require both a high-torque/low-angular displacement "break" action to disengage the contact shoulders, and a low-torque/high-angular displacement "spin" action to screw-out the threads. Connection of a tubular joint may occur in the reverse sequence. In the make/break action, torque may be high (e.g., 10,000-100,000 ft-lb), having a small (e.g., 0.12-0.24 revolutions) angular displacement. In the spin action, torque may be low (e.g., 1,000-3,000 ft-lb), having a large (e.g., 3-5 revolutions) angular displacement.

As another example, the tong control system may monitor and actuate components of the tong to provide varying clamping and rotation actions. Upper and lower jaws of the tong may turn relative to each other to break a connection between upper and lower tool joints. The upper jaw may then be released while the lower jaw remains clamped onto the lower tool joint. A spinning wrench, commonly separate from the torque wrench and mounted higher up on the carriage, may engage the stem of the upper joint of drill pipe to spin the upper joint until it is disconnected from the lower joint. Upper and lower jaws of the tong may turn relative to each other to make-up two joints of pipe. The lower jaw may grip the lower tool joint while the upper pipe is brought into position. The spinning wrench may engage the upper joint to spin it into the lower joint. The torque wrench may clamp the pipe and tighten the connection.

FIG. 1 illustrates an exemplary tool control system 100 in accordance with an embodiment of the present invention. Tool control system 100 may include hydrocarbon recovery tools 102, such as tong 102*a*, a tool mounted controller 104, and a remote controller 106.

Hydrocarbon recovery tools 102 may include any of various suitable tools for hydrocarbon recovery operations, such as tongs 102*a*, overdrive systems, elevators, mud buckets, positioning systems 102*b*, compensators, draw works, top drives, casing making devices, gripping devices, spiders, mud pumps, pickup and laydown tools, interlocks, cement heads, release balls and plugs, control line positioning tools, blowout preventers (BOPs), bails, and the like. Tools 102 may be communicatively coupled to the tool mounted controller 104, and the tool mounted controller 104 may be communicatively coupled to the remote controller 106. An exemplary remote controller is disclosed in U.S. Patent Application Publication No. 2016/0076356, which is hereby fully incorporated by reference. Tool mounted controller 104 may support bi-directional communications via one or more communications links between tools 102 and tool mounted controller 104, which may allow tool mounted controller 104 to transmit commands to tools 102 or receive information from the tools 102. For example, commands transmitted from tool mounted controller 104 to a tool 102 may change an operating parameter of the tool, cause the tool to start or stop performing a function, or instruct the tool to transmit information (e.g., operating parameters or sensor information) to tool mounted controller 104.

A bi-directional communications link may also be supported between tool mounted controller 104 and remote controller 106. The bi-directional communications link may allow tool mounted controller 104 to transmit information (e.g., device operating parameters from a tool 102) for display on remote controller 106. The communications links may also allow remote controller 106 to transmit commands to cause tool mounted controller 104 to change the operating parameters of a tool 102 or cause tool 102 to start or stop performing a function. Remote controller 106 may be a hardware remote control device or a control system accessible through a graphical human-machine interface (HMI), such as a web interface or an HMI component of a supervisory control and data acquisition (SCADA) system.

Figure 1B:
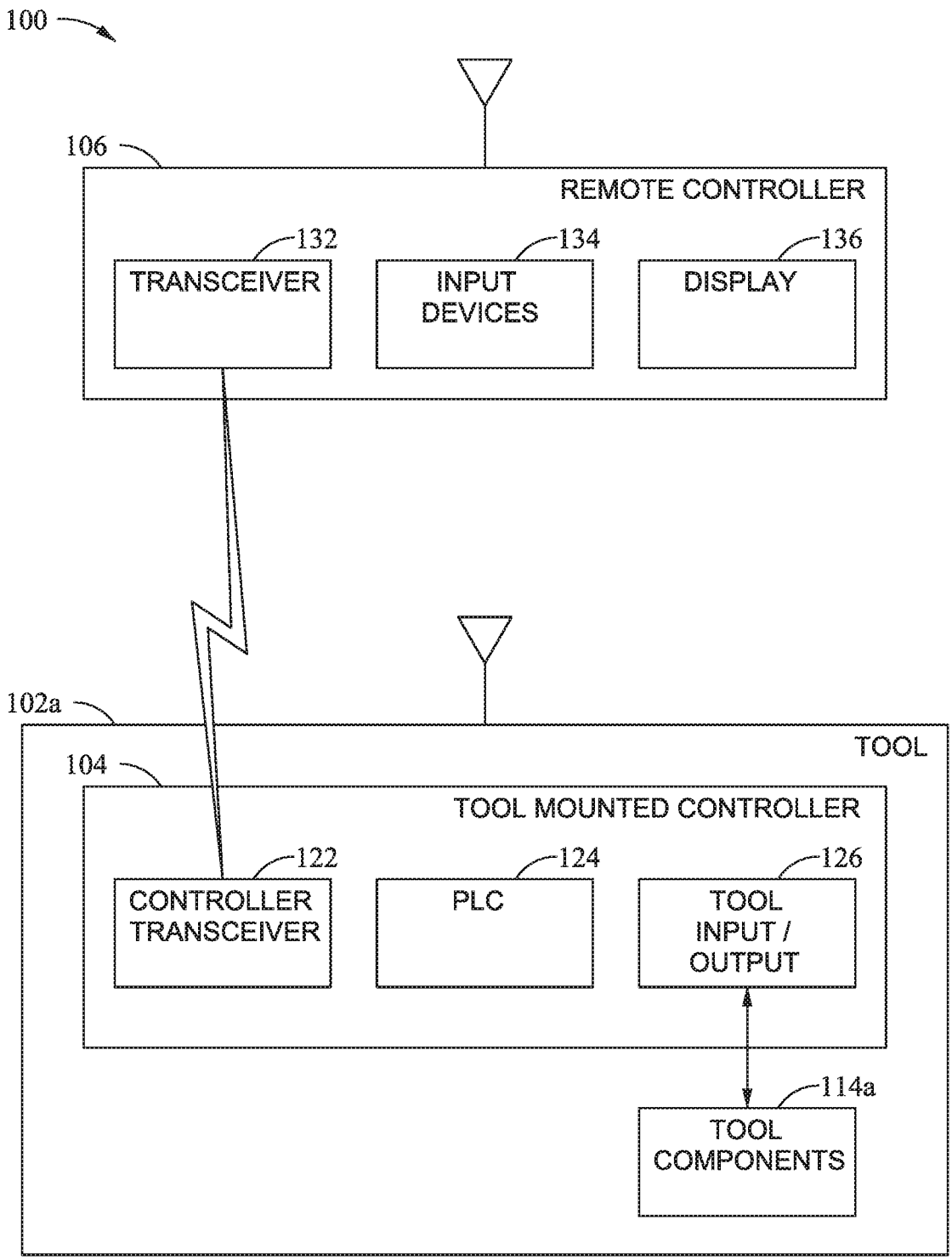
FIG. 1B is a block diagram illustrating components in a hydrocarbon recovery tool control system with a control device mounted on a tool, in accordance with embodiments of the present invention.

FIG. 1B is a block diagram of an example tool control system 100, in accordance with aspects of the present disclosure. As illustrated, hydrocarbon recovery tool control system 100 includes a tong 102*a*, a tool mounted controller 104, and a remote controller 106.

Remote controller 106 generally includes transceiver 132, input devices 134, and display 136. In some embodiments, transceiver 132 may support communications via a wired connection, such as 1000BASE-T (gigabit Ethernet) connection, a serial connection (e.g., an RS-232 connection), or some other wired connection. In some embodiments, transceiver 132 may be a wireless transceiver and may support communications via a variety of wireless protocols. For example, transceiver 132 may communicate in an 802.11 (Wi-Fi) network, an 802.16 (WiMax) network, a Uniform Terrestrial Network Access (UTRA) network (i.e., a network supporting cellular communications using the High Speed Packet Access standard), an Evolved Uniform Terrestrial Network Access (E-UTRA) network (i.e., a network supporting cellular communications using the Long Term Evolution (LTE or LTE-Advanced standards), or other wireless protocols.

In some embodiments, remote controller 106 may receive one or more screens from tool mounted controller 104 and display the one or more screens on display 136. A user may manipulate one or more input devices 134 to modify data displayed on display 136. The data may generally relate to the operation of one or more tools in a hydrocarbon recovery system. Based on user input from the one or more input devices 134, remote controller 106 may generate one or more commands and transmit the one or more commands to tool mounted controller 104 via transceiver 132.

Tool mounted controller 104 generally includes a controller transceiver 122, programmable logic computer (PLC) 124, and one or more tool input/output devices 126. Tool mounted controller 104 may be mounted directly on the hydrocarbon recovery tools 102, such as tong 102*a*, as shown in FIG. 1A.

Tool mounted controller 104 may be communicatively coupled to remote controller 106 via transceiver 122. Transceiver 122 may receive one or more commands from remote controller 106 related to operation of one of the one or more tools 102. Based on the received one or more commands, PLC 124 may generate one or more instructions to cause at least one of the one or more tools to perform an action specified by the one or more commands. After PLC 124 generates the one or more instructions, PLC 124 may output the one or more instructions to one of the tool input/output devices 126 for transmission to the at least one of the one or more tools.

Tool mounted controller 104 may be connected to one or more tools 102 via a variety of tool input/output devices 126. In some cases, tool input/output devices 126 may include a wired electrical or optical data transceiver, such as a 1000BASE-T (gigabit Ethernet) interface or a fiber channel interface. Tool input/output devices 126 may also include wireless transceivers, such as transceivers supporting communications using the 802.11 (Wi-Fi), 802.16, UTRA, E-UTRA, or other standards. Instructions transmitted via an electrical or optical connection between tool mounted controller 104 and a tool 102 may include communications compliant with an industrial communications protocol, such as PROFIBUS or MODBUS. In some cases, tool input/output devices 126 may include an analog current loop carrying current levels for configuring operation of tool 102. For example, the current loop may be a 4-20 milliamp loop or a 10-50 milliamp loop, where the lowest current corresponds to a minimum value of a parameter and the highest current corresponds to a maximum value of a parameter.

In some cases, tool input/output devices 126 may include one or more fluid power units in fluid communication with one or more of the one or more of tools 102. The fluid power units may include, for example, hydraulic pumps or pneumatic power units. PLC 124 may be communicatively coupled to the fluid power units (e.g., via an actuator) and may generate one or more instructions to cause the fluid power units to increase or decrease fluid pressure at one of the one or more of tools. For example, for hydraulically or pneumatically driven tools, PLC 124 may generate a first instruction to start operation of the tool by causing a fluid power unit associated with one of the one or more tools 102 to introduce an amount of fluid pressure to the tool. When PLC 124 determines that tool 102 has completed the requested operation, PLC 124 may generate a second instruction to cause the fluid unit to release fluid pressure at the tool.

In some cases, tools 102 generally include tool components 114*a*. Tool components 114*a* may be communicatively coupled to tool 102*a* and tool mounted controller 104. Based on the received one or more instructions, PLC 124 can cause tool components to perform an action (e.g., perform a make or break operation on a tubular string, move a positioning arm, etc.). In some cases, sensors associated with tool components 114*a* may generate data related to a current state of tool 102*a* and, via tool input/output devices 126, transmit the data to tool mounted controller 104, where the data may be logged and transmitted to remote controller 106 for display.

In some cases, tool mounted controller 104 may be calibrated to receive data from the tool components 114*a* before operation. For example, the tool mounted controller 104 may be configured to determine a clamping force exerted by tong 102*a*. A pressure transducer of the tool components 114*a* may output a signal corresponding to the clamping force exerted by tong 102*a*. The signal may be a 4-20 milliamp loop corresponding to the clamping force by a calibration factor. The calibration factor may be particular to the type of pressure transducer used to measure the clamping force. The calibration factor may be input into the tool mounted controller 104 before operation of the tong 102*a*. The tool mounted controller 104 may be configured to determine the clamping force applied by the tong 102*a* based on the signal from the pressure transducer and the calibration factor.

In some cases, tool mounted controller 104 may be configured to determine a torque applied by the tong 102*a*. For example, load cells of the tool components 114*a* may output a signal corresponding to a compression force applied by the tong 102*a*. The torque applied by the tong 102*a* may be determined based on the compression force measured by the load cells and a distance between the load cells on the tong 102*a*. The distance between the load cells and type of load cells may be input into the tool mounted controller 104 before operation of the tong 102*a*. The tool mounted controller 104 may receive a signal from the load cells corresponding to the compression force. The tool mounted controller 104 may be configured to determine the torque applied by the tong 102*a* based on the type of load cells, the measurement by the load cells, and the distance between the load cells.

Figure 2A:
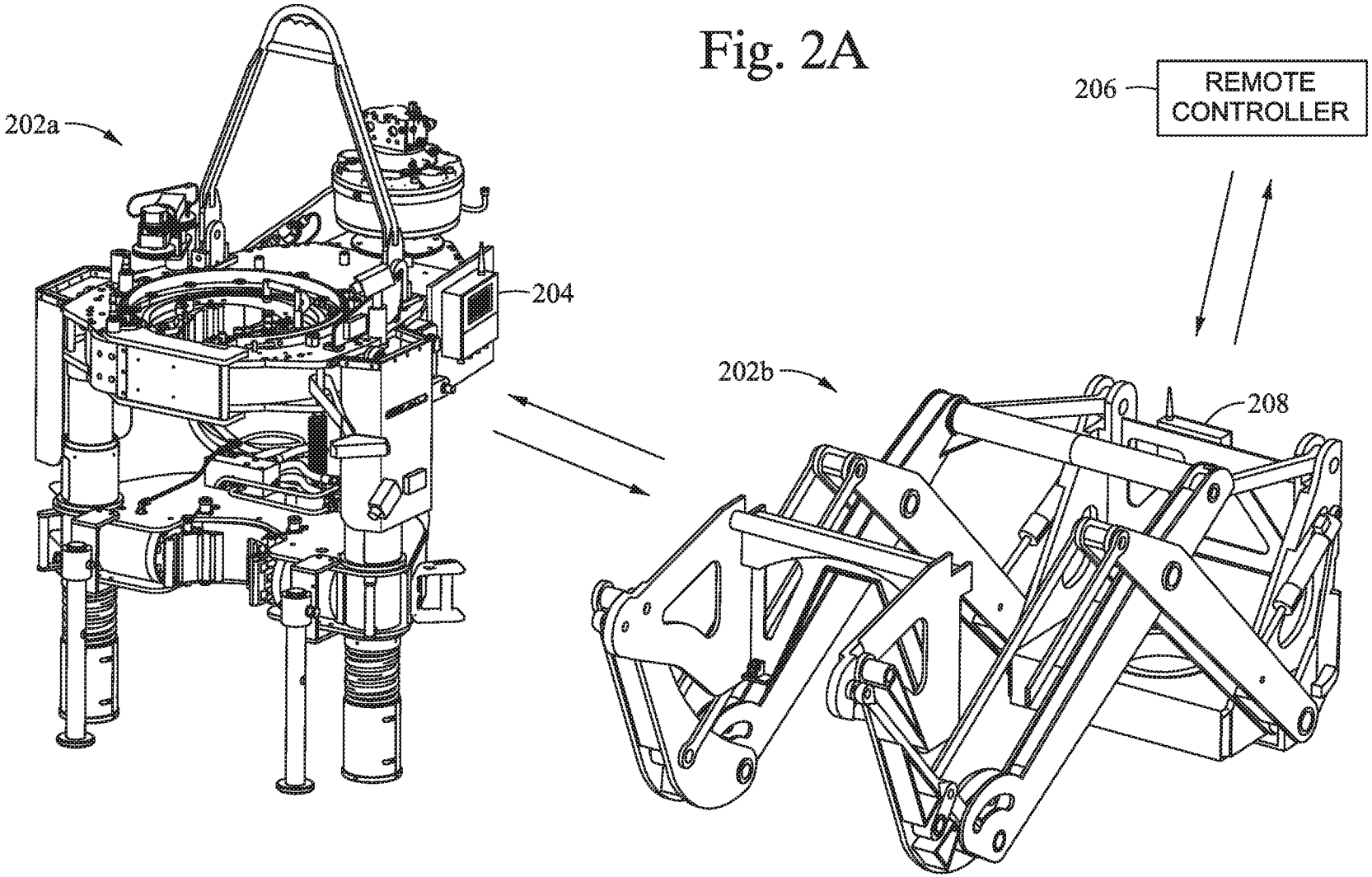
FIG. 2A illustrates an exemplary tool control system in accordance with embodiments of the present invention.

In some cases, as illustrated in FIG. 2A, each tool may be connected to an individual tool mounted controller. For example, tool 202*a* is communicatively connected to tool mounted controller 204, which is communicatively connected to a second tool mounted controller 208. Tool mounted controller 208 is communicatively connected to tool 202*b*. Tool mounted controller 204 may be configured to provide a fluid communication conduit (e.g., a hydraulic or pneumatic pass-through), a power conduit, and/or a data connection to tool mounted controller 208. Tool mounted controllers 204, 208 may support bi-directional communications via one or more communications links between tools 202*a*, 202*b*, and tool mounted controllers 204, 208, respectively. The communications links may allow tool mounted controllers 204, 208 to transmit commands to tools 202*a*, 202*b*, respectively, or receive information from the tools. For example, commands transmitted from tool mounted controller 208 to a tool 202*b* may change an operating parameter of the tool, cause the tool to start or stop performing a function, or instruct the tool to transmit information (e.g., operating parameter or sensor information) to tool mounted controller 208. In an aspect, tool 202*b* may be a positioning arm and tool 202*a* may be a tong connected to the positioning arm.

A bi-directional communications link may also be supported between tool mounted controller 208 and remote controller 206. The bi-directional communications link may allow tool mounted controller 208 to transmit information (e.g., device operating parameters from a tool 202*b*) for display on remote controller 206. The communications links may also allow remote controller 206 to transmit commands to cause tool mounted controller 208 to change the operating parameters of a tool 202*b* or cause tool 202*b* to start or stop performing a function. The bi-directional communications links may allow tool mounted controller 208 to transmit information (e.g., device operating parameters from a tool 202*a*) from the tool mounted controller 204 for display on remote controller 206. The communications links may allow transmission of commands from the remote controller 206 to the tool mounted controller 204 via the tool mounted controller 208. Remote controller 206 may be a hardware remote control device or a control system accessible through a graphical human-machine interface (HMI), such as a web interface or an HMI component of a supervisory control and data acquisition (SCADA) system.

Figure 2B:
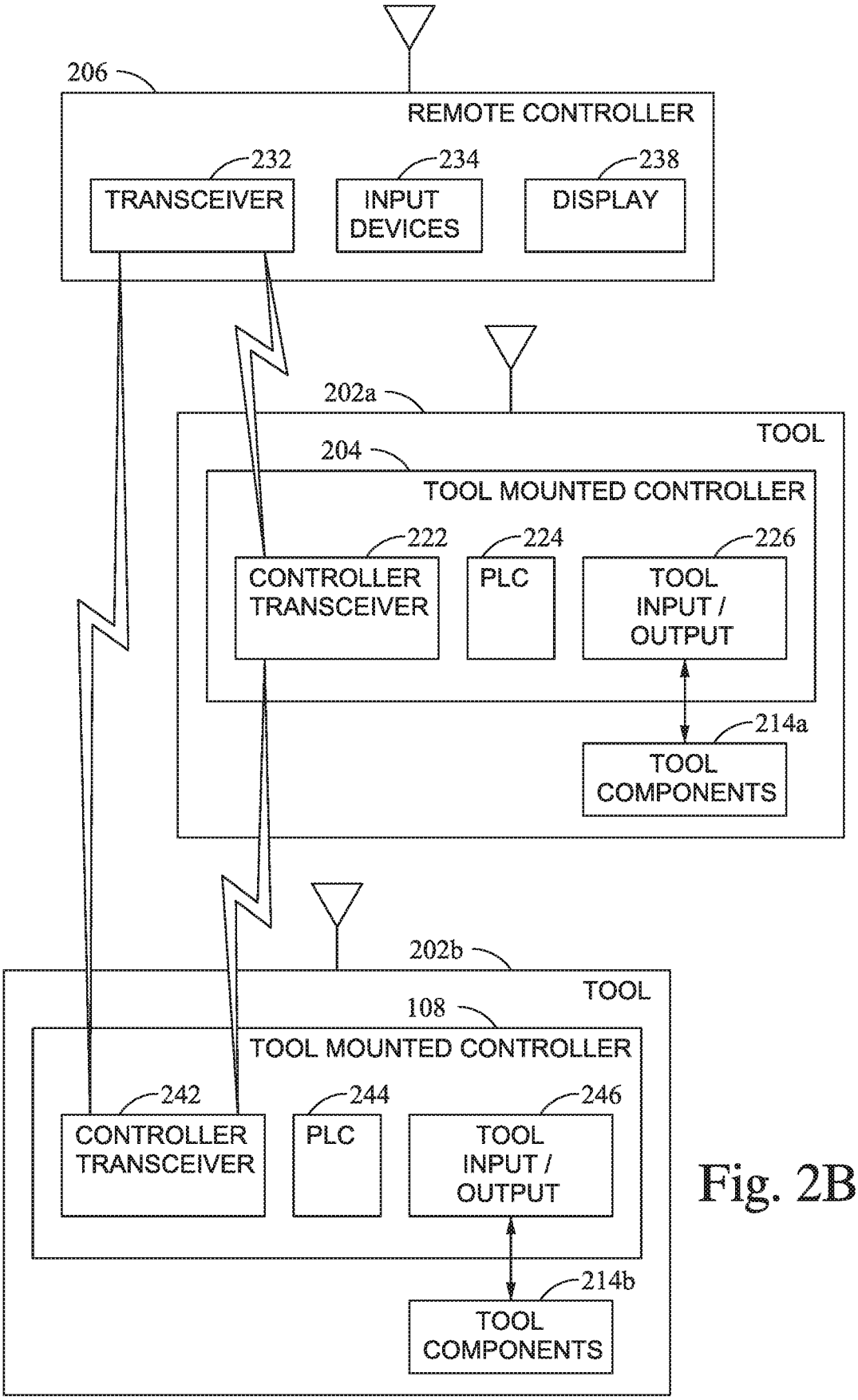
FIG. 2B is a block diagram illustrating components in a hydrocarbon recovery tool control system with a plurality of control devices mounted on separate tools, in accordance with embodiments of the present invention.

FIG. 2B is a block diagram of an example tool control system 200, in accordance with aspects of the present disclosure. As illustrated hydrocarbon recovery tool control system 200 includes a plurality of tools 202*a*, 202*b*, tool mounted controllers 204, 208, and a remote controller 206.

Remote controller 206 may be similar to the remote controller 106 from hydrocarbon recovery tool control system 100. Remote controller 206 generally includes transceiver 232, input devices 234, and display 236. In some embodiments, transceiver 232 may support communications via a wired connection, such as 1000BASE-T (gigabit Ethernet) connection, a serial connection (e.g., an RS-232 connection), or some other wired connection. In some embodiments, transceiver 232 may be a wireless transceiver and may support communications via a variety of wireless protocols. For example, transceiver 232 may communicate in an 802.11 (Wi-Fi) network, an 802.16 (WiMax) network, a Uniform Terrestrial Network Access (UTRA) network (i.e., a network supporting cellular communications using the High Speed Packet Access standard), an Evolved Uniform Terrestrial Network Access (E-UTRA) network (i.e., a network supporting cellular communications using the Long Term Evolution (LTE or LTE-Advanced standards), or other wireless protocols.

In some embodiments, remote controller 206 may receive one or more screens from tool mounted controllers 204, 208 and display the one or more screens on display 236. A user may manipulate one or more input devices 234 to modify data displayed on display 236. The data may generally relate to the operation of one or more tools in a hydrocarbon recovery system. Based on user input from the one or more input devices 234, remote controller 206 may generate one or more commands and transmit the one or more commands to tool mounted controllers 204, 208 via transceiver 232.

Tool mounted controller 204 generally includes a controller transceiver 222, programmable logic computer (PLC) 224, and one or more tool input/output devices 226. Tool mounted controller 204 may be mounted directly on the hydrocarbon recovery tools 202, such as tong 202*a*, as shown in FIG. 2A. Tool mounted controller 208 generally includes a controller transceiver 242, programmable logic computer (PLC) 244, and one or more tool input/output devices 246. Tool mounted controller 208 may be mounted directly on the hydrocarbon recovery tools 202, such as positioning arm 202*b*, as shown in FIG. 2A.

Tool mounted controller 204 may be communicatively coupled to remote controller 206 via transceiver 222. Transceiver 222 may receive one or more commands from remote controller 206 related to operation of tool 202*a*. Based on the received one or more commands, PLC 224 may generate one or more instructions to cause at least one of the one or more tools to perform an action specified by the one or more commands. After PLC 224 generates the one or more instructions, PLC 224 may output the one or more instructions to one of the tool input/output devices 226 for transmission to the tool 202*a*.

Tool mounted controller 208 may be communicatively coupled to remote controller 206 via transceiver 242. Transceiver 242 may receive one or more commands from remote controller 206 related to operation of 202*b*. Based on the received one or more commands, PLC 244 may generate one or more instructions to cause at least one of the one or more tools to perform an action specified by the one or more commands. After PLC 244 generates the one or more instructions, PLC 244 may output the one or more instructions to one of the tool input/output devices 246 for transmission to the tool 202*b*.

Tool mounted controller 204 may be connected to tool 102*a* via a variety of tool input/output devices 226. In some cases, tool input/output devices 226 may include a wired electrical or optical data transceiver, such as a 1000BASE-T (gigabit Ethernet) interface or a fiber channel interface. Tool input/output devices 226 may also include wireless transceivers, such as transceivers supporting communications using the 802.11 (Wi-Fi), 802.16, UTRA, E-UTRA, or other standards. Instructions transmitted via an electrical or optical connection between tool mounted controller 204 and a tool 202*a* may include communications compliant with an industrial communications protocol, such as PROFIBUS or MODBUS. In some cases, tool input/output devices 226 may include an analog current loop carrying current levels for configuring operation of tool 202. For example, the current loop may be a 4-20 milliamp loop or a 10-50 milliamp loop, where the lowest current corresponds to a minimum value of a parameter and the highest current corresponds to a maximum value of a parameter.

Tool mounted controller 208 may be connected to tool 202*b* via a variety of tool input/output devices 246. In some cases, tool input/output devices 246 may include a wired electrical or optical data transceiver, such as a 1000BASE-T (gigabit Ethernet) interface or a fiber channel interface. Tool input/output devices 246 may also include wireless transceivers, such as transceivers supporting communications using the 802.11 (Wi-Fi), 802.16, UTRA, E-UTRA, or other standards. Instructions transmitted via an electrical or optical connection between tool mounted controller 208 and a tool 202*b* may include communications compliant with an industrial communications protocol, such as PROFIBUS or MODBUS. In some cases, tool input/output devices 246 may include an analog current loop carrying current levels for configuring operation of tool 202*b*.

In some cases, tool input/output devices 226, 246 may include one or more fluid power units in fluid communication with the tools 202*a*, 202*b*, respectively. The fluid power units may include, for example, hydraulic pumps or pneumatic power units. PLCs 224, 244 may be communicatively coupled to the fluid power units (e.g., via an actuator) and may generate one or more instructions to cause the fluid power units to increase or decrease fluid pressure at the tools 202*a*, 202*b*, respectively. For example, for hydraulically or pneumatically driven tools, PLC 224 may generate a first instruction to start operation of the tool 202*a* by causing a fluid power unit associated with 202*a* to introduce an amount of fluid pressure to the tool. When PLC 224 determines that tool 202*a* has completed the requested operation, PLC 224 may generate a second instruction to cause the fluid unit to release fluid pressure at the tool.

In some cases, tools 202*a*, 202*b* generally include tool components 214*a*, 214*b*. Tool components 214*a*, 214*b* may be communicatively coupled to tool 202*a*, 202*b* and tool mounted controller 204, 208, respectively. Based on the received one or more instructions, PLCs 224, 244 can cause tool components to perform an action (e.g., perform a make or break operation on a tubular string, move a positioning arm, etc.). In some cases, sensors associated with tool components 214*a*, 214*b* may generate data related to a current state of tool 202*a*, 202*b*, respectively, and, via tool input/output devices 226, 246, transmit the data to tool mounted controller 104, 108 where the data may be logged and transmitted to remote controller 206 for display.

Remote controller 206 may generate one or more instructions to command operation of tools 202*a*, 202*b*. In aspects where the instructions comprise data signals transmitted via an electrical or optical medium, the instructions may indicate the device for which the instructions are intended. Tool mounted controller 204 may receive the one or more instructions from the remote controller 206. PLC 224 may read the one or more instructions and determine whether or not the instructions are intended for operation of tool 202*a*. If the instructions are intended for operation of tool 202*a*, PLC 224 may take one or more actions to cause tool components 214*a* to perform according to the instructions. If, however, the instructions are intended for operation of tool 202*b*, PLC 224 may cause the instructions to be transmitted to tool mounted controller 208 via controller transceiver 222. At tool 202*b*, the instructions may be received at the tool mounted controller 208 via the controller transceiver 242 and processed by PLC 244 to determine whether the instruction is intended for operation of tool 202*b* or for yet another tool connected below tool 202*b*. If the instructions are intended for operation of tool 202*b*, PLC 244 may take one or more actions to cause tool components 214*a* to perform according to the instructions.

In some cases, tool I/O devices may comprise a fluid communication conduit. Fluid pressure generated by tool mounted controller 204 and transmitted to tool 202*a* may be passed through a tool I/O device to a tool I/O device of tool mounted controller 208. Tool 202*a* may be actuated and controlled by the supply of pressurized fluid from tool mounted controller 204. Tool 202*b* may be actuated and controlled by the supply of pressurized fluid from tool mounted controller 208.

In some cases, remote controller 206 may be located in a driller's cabin, which may be remote from the rigfloor (i.e., an explosive zone). Tool mounted controllers 204, 208 may be mounted on one of the tools 202*a*, 202*b*, respectively, and located at the rigfloor and packaged in an explosion-proof housing. Remote controller 206 may be communicatively coupled to tool mounted controller 204 via a wired or wireless electrical connection or a fiber connection, as discussed above. Tool mounted controller 204 may be connected to tool 202*a* using electrical, hydraulic, and/or pneumatic connections. Tool mounted controller 204 may be communicatively coupled to tool mounted controller 208 via a wired or wireless electrical connection or a fiber connection, as discussed above. Tool mounted controller 208 may be connected to tool 202*b* using electrical, hydraulic, and/or pneumatic connections. In some cases, as described above, some tools may be coupled to individual tool mounted controllers and communicatively coupled to tool mounted controller 204 through the other tool mounted controllers.

Figure 3A:
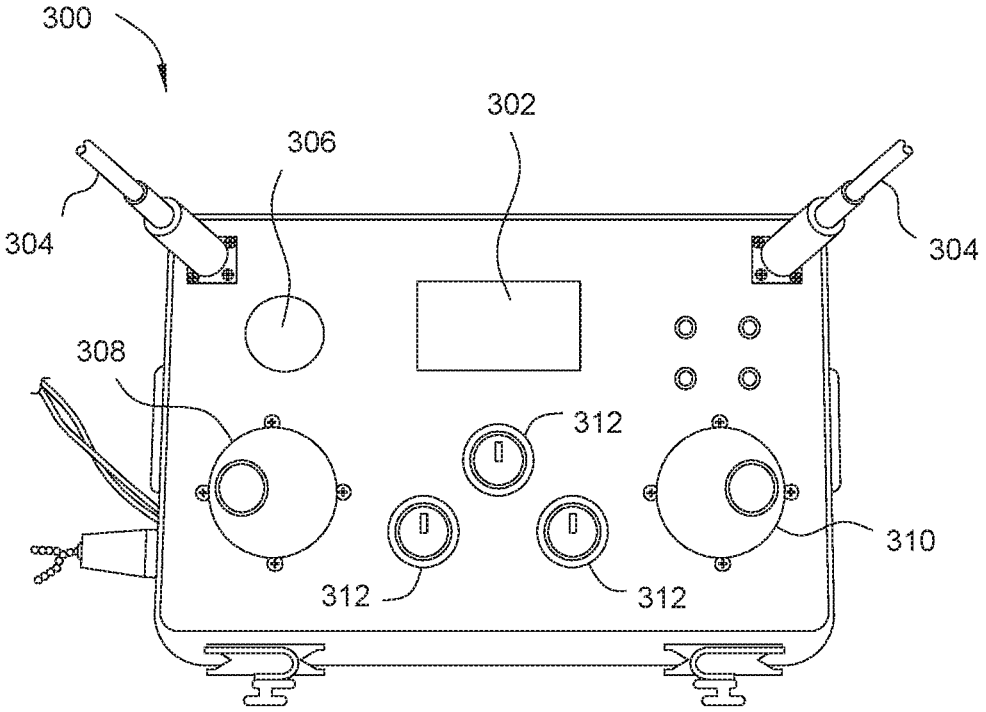
FIG. 3A illustrates an example remote control panel, in accordance with embodiments of the present invention.

FIG. 3A illustrates an example remote control panel 300, in accordance with embodiments of the present invention. Remote control panel 300 may operate as a remote controller 106, 206 and may be a universal remote control panel capable of controlling several tools. Remote control panel 300 may include a display 302, one or more wireless antennas 304, an emergency stop button 306, a first joystick 308 (or other directional controller), and one or more optional legacy controls 212 (e.g., rotary switches). Display 302 may be configured to display a plurality of parameters and commands for a tool being currently controlled by remote control panel 300. The contents of display 302 may change depending on the type of tool selected. For example, display 302 may present a first plurality of operating parameters and commands if a first tool (e.g., tongs) is selected, a second plurality of operating parameters and commands if a second tool (e.g., a positioning arm) is selected, and so on.

Remote control panel 300 may communicate with one or more tool mounted controllers 104, 204, 208 via one or more wireless antennas 304 or wired connections. As illustrated, remote control panel 300 communicates via two antennas 304 for antenna diversity; however, any number of antennas may be used.

Emergency stop button 306 may be used to stop one or more tools controlled by remote control panel 300 via one or more tool mounted controllers 104, 204, 208. If emergency stop button 306 is activated, remote control panel 300 may transmit, via wireless antennas or wired connections, one or more commands to one or more tool mounted controllers 104, 204, 208 commanding the tool mounted controller(s) to stop a particular tool or all tools controlled by tool mounted controllers 104, 204, 208 (e.g., by discontinuing power flow to one or more tools). In this manner, the tool(s) can quickly shutdown to prevent damage to the tool(s) or injury caused by the tool(s), for example.

Selection and modification of parameters may be performed using first and second joysticks 308, 310. One or both of first and second joysticks 308, 310 may act as a toggle or selection button to perform an action (e.g., returning a tool to a default position, commanding a tool to start or stop operations, and so on). For example, first joystick 308 may be configured to change parameter values (e.g., by moving the first joystick up or down) or move the focus of inputs from first joystick 308 from one field to another (e.g., by moving the first joystick left or right), while second joystick 310 may be configured to command the performance of one or more hardware actions. The functionality of first and second joysticks 308, 310 may change based on the status of remote control panel 300 (e.g., a powering on state, an error handling state), the tool selected, and the mode in which remote control panel 300 is operating in (e.g., a data mode, where parameters of a tool can be viewed and/or modified, or a control mode, where a tool can be commanded to start or stop operations).

Remote control panel 300 may optionally have one or more "legacy" device controls 312. As illustrated in FIG. 3, remote control panel 300 has three legacy device controls 312; however, any desired number of legacy device controls 312 may be present on remote control panel 300. Legacy device controls 312 may be used to operate various functions on one or more tools. For example, legacy device controls 312 may be used to open or close tongs, switch tongs or an overdrive controller from make mode (i.e., a mode in which two tubulars are connected to each other) to break mode (i.e., a mode in which two tubulars are disconnected from each other), change control from manual control to automatic control, or other functionality as desired. Legacy device controls 312 may be used in lieu of or in conjunction with display 302 and first and second joysticks 308, 310.

Figure 3B:
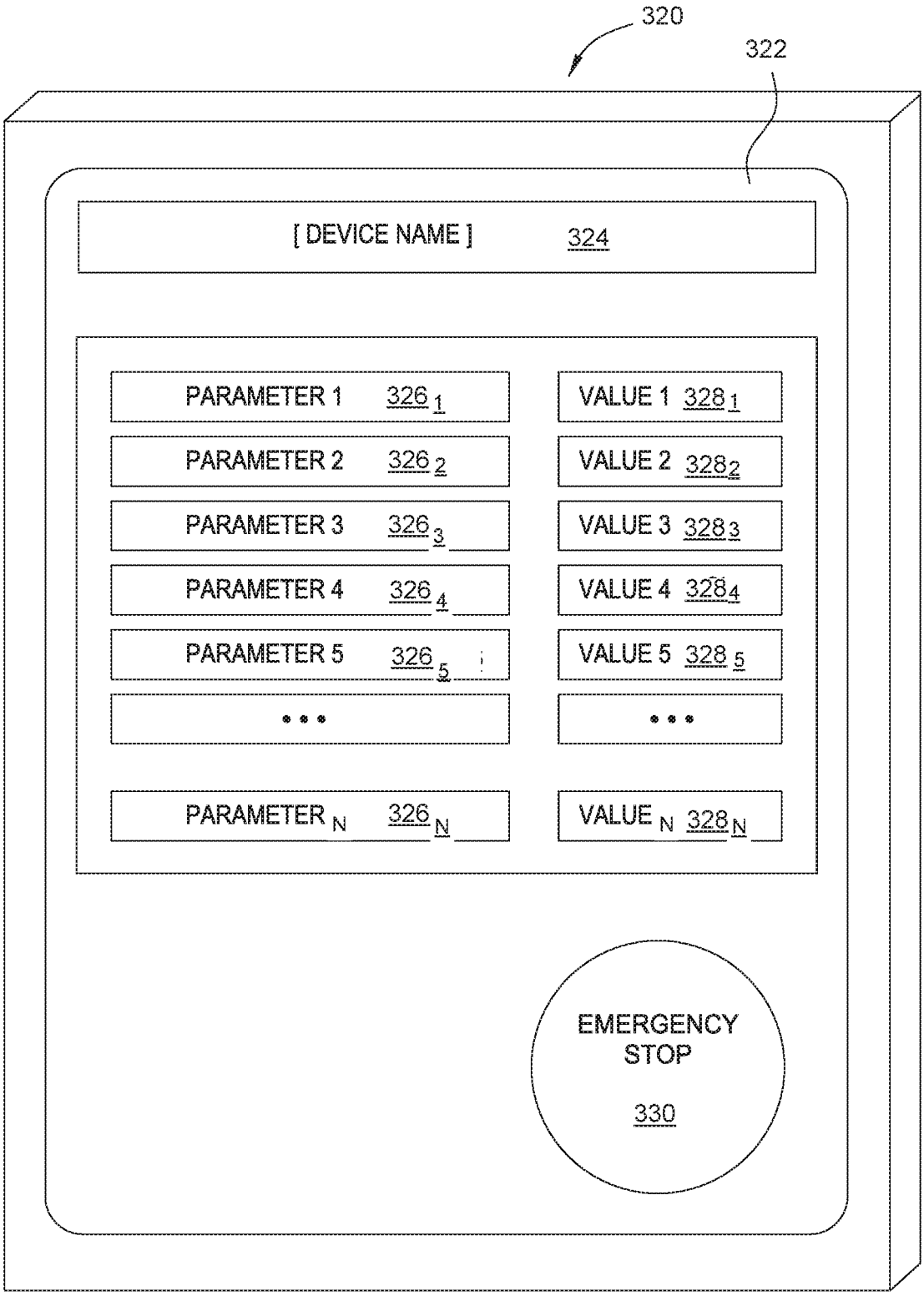
FIG. 3B illustrates an example human-machine interface (HMI) that may be used to control a plurality of tools, in accordance with embodiments of the present invention.

As an alternative (or a supplement) to remote control panel 300, FIG. 3B illustrates an example human-machine interface (HMI) 322 that may be used to control a plurality of tools, in accordance with embodiments of the present invention. A display device 320 may be used to display HMI 322. Display device 322 may be a smartphone, tablet, a personal digital assistant (PDA), monitor, or any other visual display device as desired and may include one or more network interfaces that may be used to connect to and communicate with one or more tool mounted controllers 104, 204, 208. The display for such a device may be a touchscreen and may accept input through a stylus, touch, proximity of a finger, or a combination thereof. Inputs generated on a touchscreen may be used to interact with data elements presented on HMI 322. For example, display device 320 may utilize a wireless local area network (WLAN) interface (e.g., an IEEE 802.11 interface), a cellular network interface (e.g., Long Term Evolution (LTE) or Universal Mobile Telecommunication System (UMTS) interfaces), personal area network (PAN) interfaces, or other network interfaces, as desired.

HMI 322 may be configured to display a plurality of fields corresponding to the various tools connected with the one or more tool controllers 104, 204, 208. A user can select a device, for example, using a drop-down menu 324 (as illustrated), a graphical representation of the device, or any other manner of selecting a device on a graphical user interface (GUI). After a device is selected, HMI 322 may be populated with one or more parameter fields 3261-326N, which may present parameters or operations of the selected device. Parameter fields 3061-306N may each have a corresponding value field 3281-328N. Each of the value fields 328 may be an editable text field (e.g., for changing the value of a parameter), a toggle button (e.g., for switching operating modes), or some other suitable graphical field. HMI 322 may further have an emergency stop button 330, which may act similarly to emergency stop button 306 of remote control panel 300.

Figure 4:
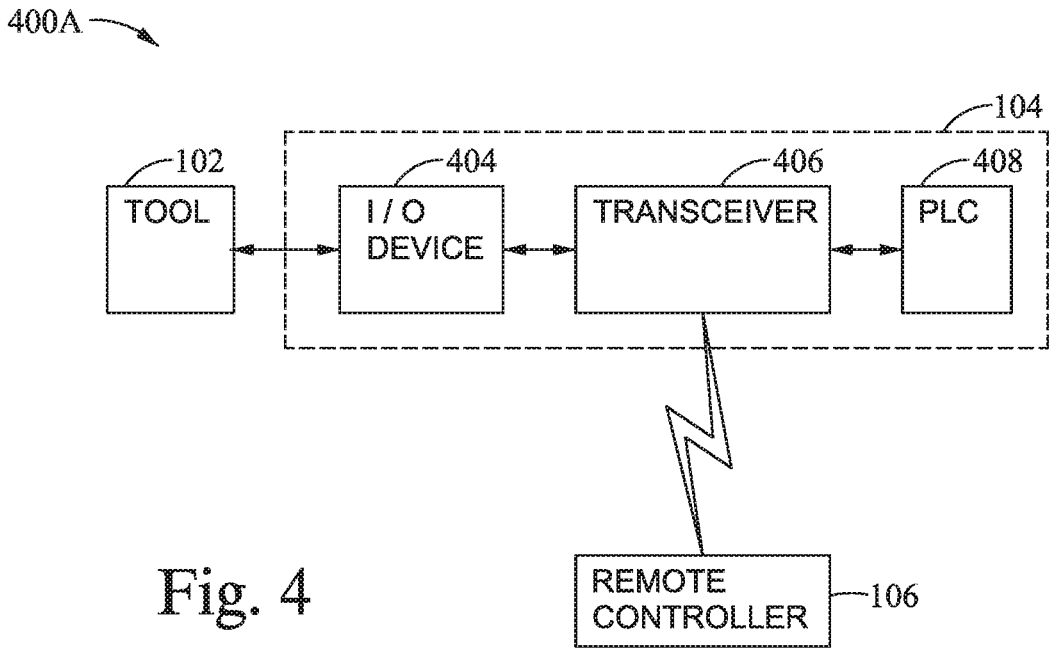
FIG. 4 illustrates an exemplary tool control system with a wireless receiver, in accordance with embodiments of the present invention.

FIG. 4 illustrates a block diagram of a remotely controlled tool system 400A, in accordance with embodiments of the present invention. As illustrated, tool mounted controller 104 may comprise a tool input-output I/O device 404, a transceiver 406, and a programmable logic controller (PLC) 408. I/O device 404, transceiver 406, and PLC 408 may be connected to each other, for example, via a communications bus. For example, I/O device 404, transceiver 406, and PLC 408 may communicate with each other via a communications bus over which messages compliant with the MODBUS protocol, PROFIBUS protocol, or other any other desired communications protocol, may be transmitted.

Remote controller 106 may be connected with tool mounted controller 104 via a wired or wireless connection with transceiver 406. Transceiver 406 may have one or more antennas and may receive commands from remote controller 106 at the one or more antennas to change parameters of a tool 102 or change the operating state of tool 102. Commands received from remote controller 106 may be routed from transceiver 406 to PLC 408 for processing by PLC 408. For example, PLC 408 may receive a command from remote controller 106 to change the value of a certain parameter for a specified tool 102 to a particular value. To change an operating state of tool 102, PLC 408 may receive a command from remote controller 106 to change the operating state of tool 102 (e.g., to change from a stopped state to a running state). After processing the command to change the operating state of tool 102, PLC 408 may transmit one or more commands, via I/O device 404, to tool 102 to instruct the tool to perform a specified function.

By way of illustration, if a user issues a command through remote controller 106 to begin making a tubular using tongs, PLC 408 may transmit one or more commands to cause the tongs to grip a first tubular with a first pair of tongs, grip a second tubular with a second pair of tongs, and apply a specified amount of torque to one of the tubulars to make a connection between the first and second tubulars.

Figure 5:
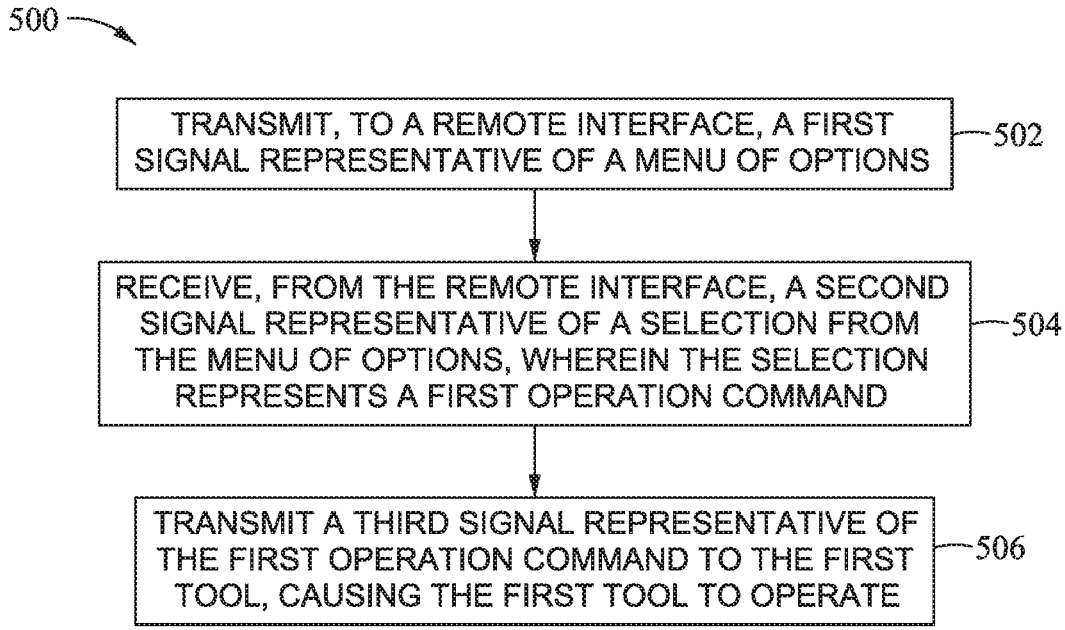
FIG. 5 is a flow diagram of example operations performed by a control device for controlling a tool at a work location, in accordance with embodiments of the present invention.

FIG. 5 illustrates operations 500 that may be performed, for example, by a control device, such as tool mounted controller 104 or PLC 408 to control a first tool at a work location, in accordance with embodiments of the present invention. Operations 500 may begin at 502, where the control device transmits a first signal representative of a menu of options to a remote interface. The menu of options may, for example, represent operation commands for the first tool. At 504, the control device receives from the remote interface a second signal representative of a first operation command. At 506, the control device transmits a third signal representative of the first operation command to the first tool, which may cause the tool to operate.

Figure 6:
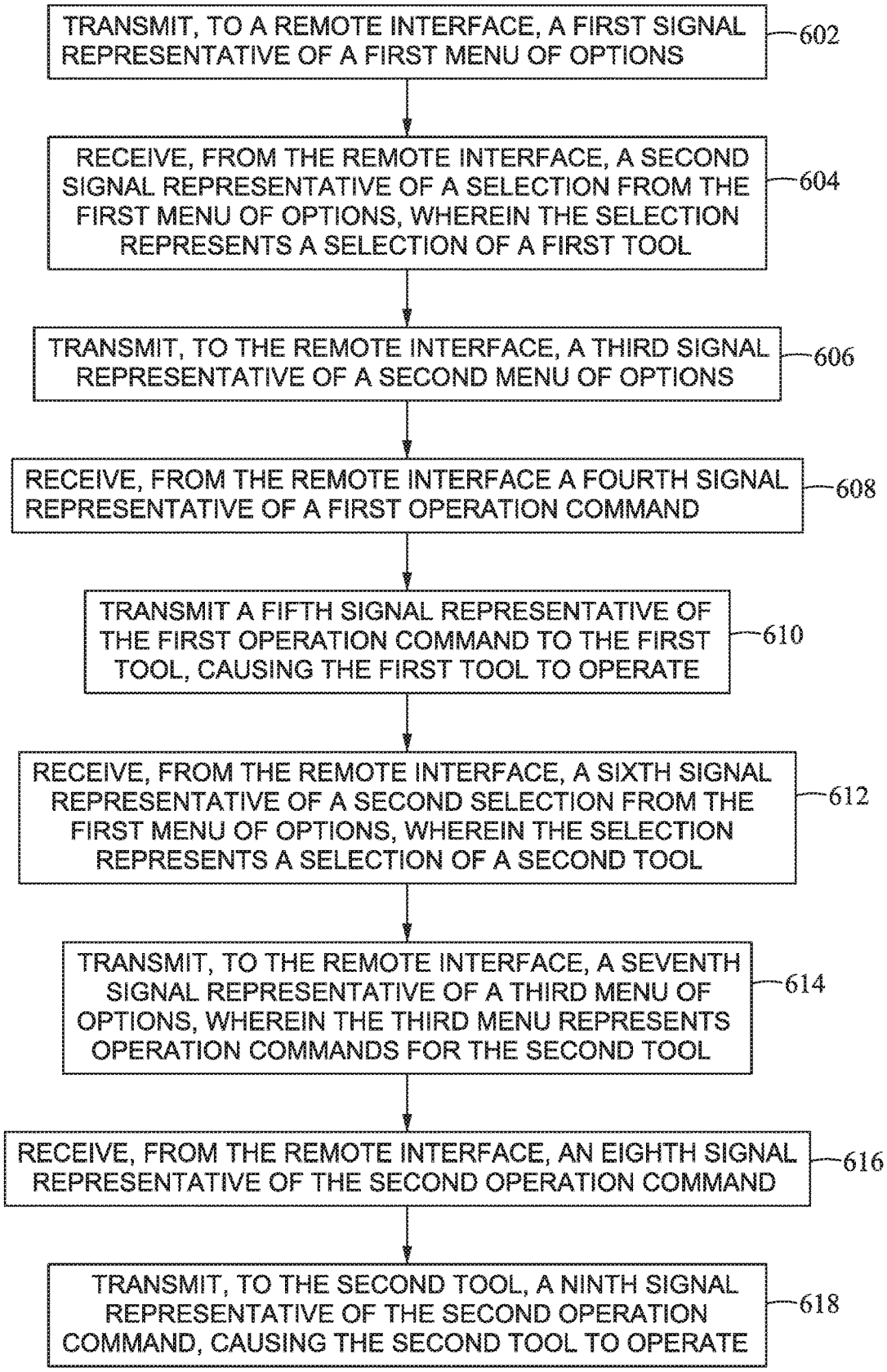
FIG. 6 is a flow diagram of example operations performed by a plurality of control devices to control tools at a work location, in accordance with embodiments of the present invention.

FIG. 6 illustrates operations 600 that may be performed, for example, by a plurality of control devices, such as a plurality of tool mounted controllers 204, 208 to control tools at a work location, in accordance with embodiments of the present invention. Operations 600 may begin at 602, where a first control device transmits a first signal representative of a first menu of options to a remote interface. At 604, the first control device receives, from the remote interface, a second signal representative of a first selection from the first menu of options. The selection may represent a choosing of a first tool from a set of tools. At 606, the first control device transmits a third signal representative of a second menu of options to the remote interface. The second menu of options may, for example, represent operation commands for the first tool. At 608, the first control device receives a fourth signal representative of a first operation command from the remote interface. At 610, the first control device transmits a fifth signal representative of the first operation command to the first tool, which may cause the first tool to operate. At 612, the second control device receives, from the remote interface, a sixth signal representative of a second selection from the first menu of operations. The second selection may represent, for example, a choosing of a second tool out of the set of tools. At 614, the second control device transmits a seventh signal to the remote interface. The seventh signal may be representative of a third menu of options, which may represent operation commands for the second tool. At 616, the second control device receives an eighth signal representative of the second operation command from the remote interface. At 618, the second control device transmits, to the second tool, a ninth signal representative of the second operation command, thereby causing the second tool to operate.

Figure 7:
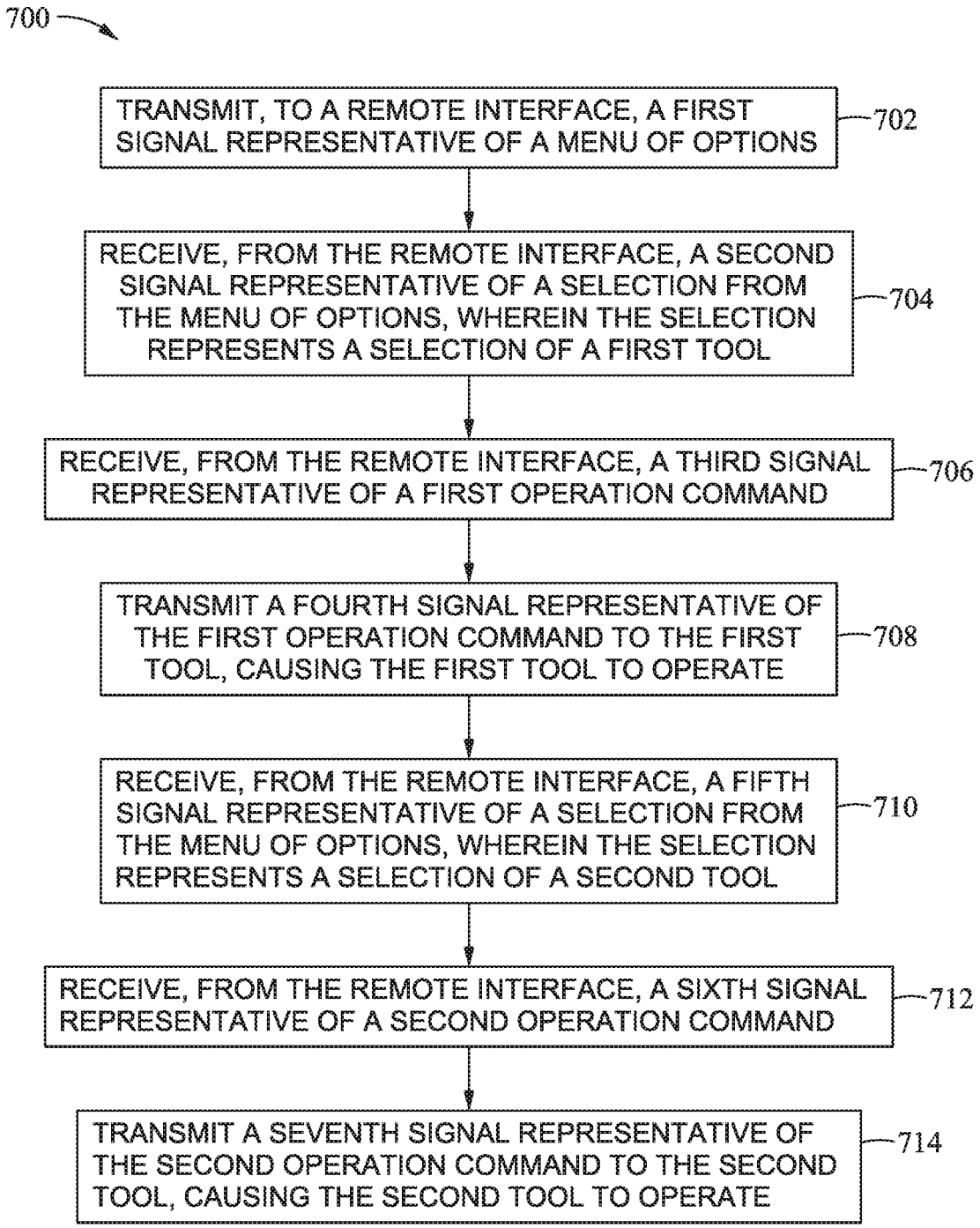
FIG. 7 is a flow diagram of example operations performed by a plurality of control devices to control tools at a work location, in accordance with embodiments of the present invention.

FIG. 7 illustrates operations 700 that may be performed, for example, by a plurality of control devices, such as a plurality of tool mounted controllers 204, 208 to control tools at a work location, in accordance with embodiments of the present invention. Operations 700 may begin at 702, where a first control device of the plurality of control devices transmits a first signal representative of a menu of options to a remote interface. At 704, the first control device receives from the remote interface a second signal representative of a selection from the menu of options. The selection may represent a selection of a first tool in the set of tools. At 706, the first control device receives a third signal representative of a first operation command. At 708, the first control device transmits a fourth signal representative of the first operation command to the first tool. The fourth signal may cause the first tool to operate. At 710, a second control device receives from the remote interface a fifth signal representative of a selection from the menu of options. The selection may represent a selection of a second tool in the set of tools. At 712, the second control device receives from the remote interface a sixth signal representative of a second operation command. At 714, the second control device transmits a seventh signal representative of the second operation command to the second tool. The seventh signal may cause the second tool to operate.

Figure 8:
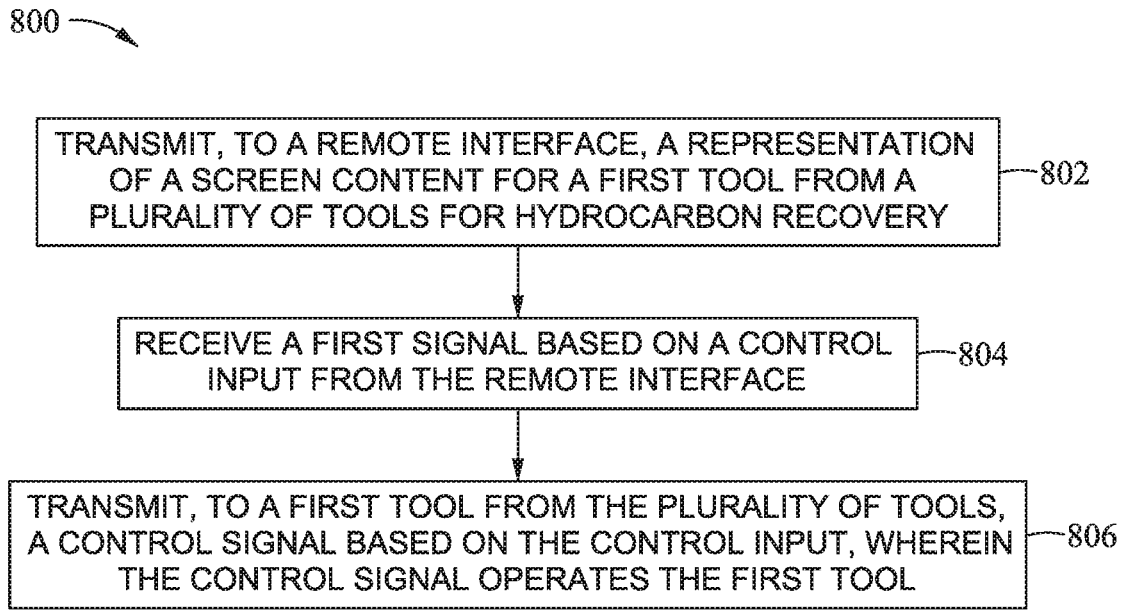
FIG. 8 is a flow diagram of example operations performed by one or more control devices to control one or more tools for hydrocarbon recovery, in accordance with embodiments of the present invention.

FIG. 8 illustrates example operations 800 that may be performed, for example, by one or more control devices, such as tool mounted controller 104 or a plurality of tool mounted controllers 204, 208 to control one or more tools for hydrocarbon recovery. Operations 800 begin at block 802, where a first control device transmits to a remote interface a representation of a screen content for a first tool of the one or more tools for hydrocarbon recovery. At block 804, the first control device may receive a first signal based on a control input from the remote interface. At 806, the first control device transmits to the first tool from the one or more tools, a control signal based on the control input. The control signal may operate the tool.

For some embodiments, operations 800 may further include transmitting, from the first control device, a second signal to the second control device based on a control input from the remote interface; transmitting, from the second control device, a control signal based on the control input to a second tool. The control signal may operate the second tool.

For some embodiments, operations 800 may further include receiving a third signal at the first control device from the first tool; updating, at the first control device, a screen content for the remote interface to display based on the third signal; and transmitting, from the first control device to the remote interface, a fourth signal with a representation of the updated screen content for the remote interface to display.

For some embodiments, operations 800 may further include receiving a fifth signal at the second control device from the second tool; updating, at the second control device, a screen content for the remote interface to display based on the fourth signal; and transmitting, from the second control device to the remote interface, a sixth signal with a representation of the updated screen content for the remote interface to display.

For some embodiments, operations 800 may further involve receiving, at a first or second control device, information from a first or second tool, respectively. Based on the information, the first or second control device may transmit to the remote interface a signal with a representation of a screen content for the remote interface to display. For example, the previous operations may precede block 802.

For some embodiments, the updated screen content may comprise a new menu screen for the first or second tool.

Figure 9:
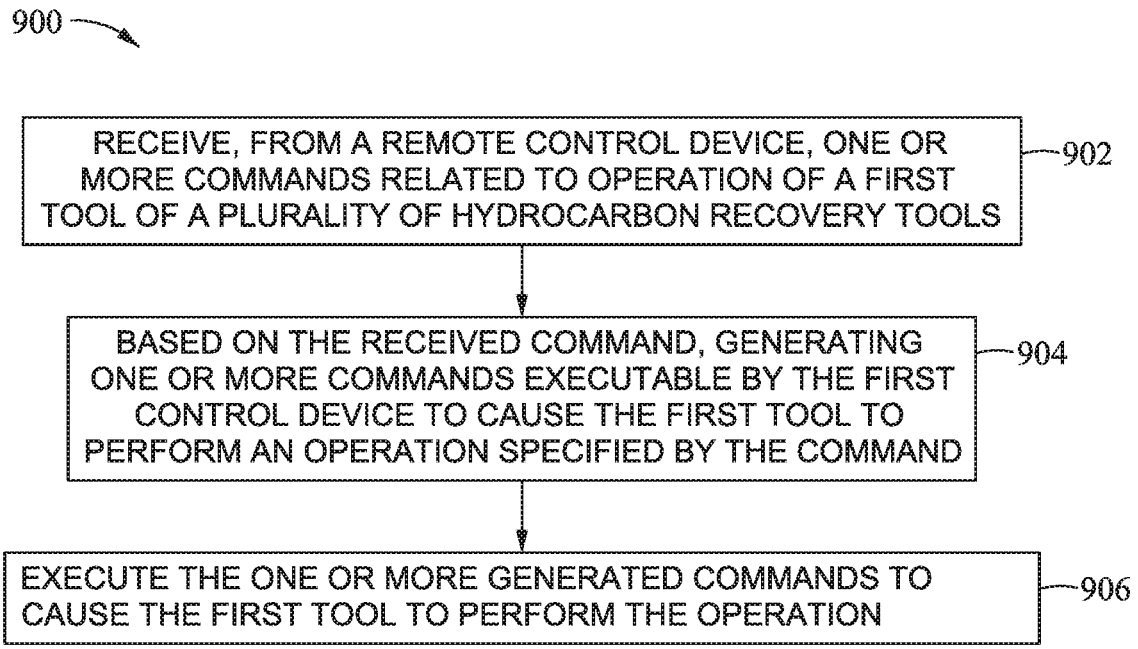
FIG. 9 is a flow diagram of example operations performed by a plurality of control devices to control a plurality of hydrocarbon recovery tools, in accordance with embodiments of the present invention.

FIG. 9 illustrates example operations 900 that may be performed, for example, by a plurality of control devices, such as a plurality of tool mounted controllers 204, 208 to control a plurality of hydrocarbon recovery tools. Operations 900 may begin at block 902, where the first device controller receives, from a remote control device, one or more commands related to operation of a first tool of a plurality of hydrocarbon recovery tools. At block 904, based on the received command, the first device controller generates one or more commands executable by the first control device to cause the first tool to perform an operation specified by the received command. At block 906, the first device controller executes the one or more generated commands to cause the first tool of the plurality of tools to perform the operation specified by the received command.

For some embodiments, operations 900 may further involve transmitting, from the first device controller, one or more commands related to operation of a second tool of the plurality of hydrocarbon recovery tools to a second device controller associated with the second tool. Based on the received command, the second device controller generates one or more commands executable by the second device controller to cause the second tool to perform an operation specified by the received command. The second device controller executes the one or more generated commands to cause the second tool of the plurality of tools to perform the operation specified by the received command. For example, the previous operations may follow block 906.

For some embodiments, operations 900 may further include transmitting, to the remote control device, one or more screens associated with each of the plurality of tools. The one or more screens may include one or more options for operating each tool in the plurality of tools. The received command may include a command to operate at least one of the plurality of tools using parameters for the at least one of the plurality of tools modified on the one or more screens.

For some embodiments, generating one or more commands executable by the first or second control device to cause the first or second tool to perform an operation specified by the received command comprises generating one or more electronic instructions to command operation of the first or second tool. Additionally, generating one or more commands may include triggering actuation of one or more fluid power devices in fluid communication with the tool. Triggering actuation of the one or more fluid power devices may modify one or more operating parameters of the tool.

Figure 10:
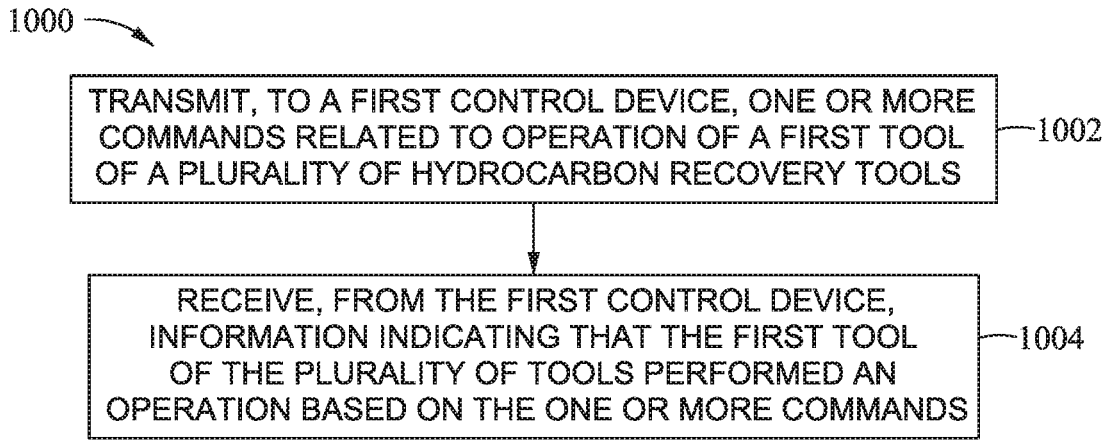
FIG. 10 is a flow diagram of example operations performed by a remote controller for controlling a plurality of hydrocarbon recovery tools, in accordance with embodiments of the present invention.

FIG. 10 illustrates example operations 1000 that may be performed, for example, by a plurality of control devices, such as tool mounted controllers 204, 208, for controlling a plurality of hydrocarbon recovery tools, according to some embodiments. Operations 1000 may begin at 1002, where a remote controller transmits, to a first control device one or more commands related to operation of at least one of a plurality of hydrocarbon recovery tools. At 1004, the remote controller receives, from the first control device, information indicating that the at least one of a plurality of tools performed an operation based on the one or more commands.

For some embodiments, operations 1000 further include transmitting, from the first control device, the one or more commands related to operation of at least one of a plurality of hydrocarbon recovery tools to a second control device; receiving, at the remote controller, from the second control device information indicating that the at least one of a plurality of tools performed an operation based on the one or more commands. For example, the previous operations may precede block 1004.

For some embodiments, operations 1000 further include receiving, from the first control device and second control device, one or more screens associated with each of the plurality of tools. The one or more screens may generally include one or more operations for operating each of the plurality of tools. The transmitted one or more commands may generally include a command to operate the at least one of the plurality of tools using parameters for the at least one of the plurality of tools modified on the one or more screens.

Any of the operations described above, may be included as instructions in a non-transitory computer-readable medium for execution by the remote controller 106, tool mounted controllers 104, 204, 208, PLC 408, or any other processing system. The computer-readable medium may comprise any suitable memory for storing instruction, such as read-only memory (ROM), random access memory (RAM), flash memory, an electrically erasable programmable ROM (EEPROM), a compact disc ROM (CD-ROM), or a floppy disk.

Figure 11A:
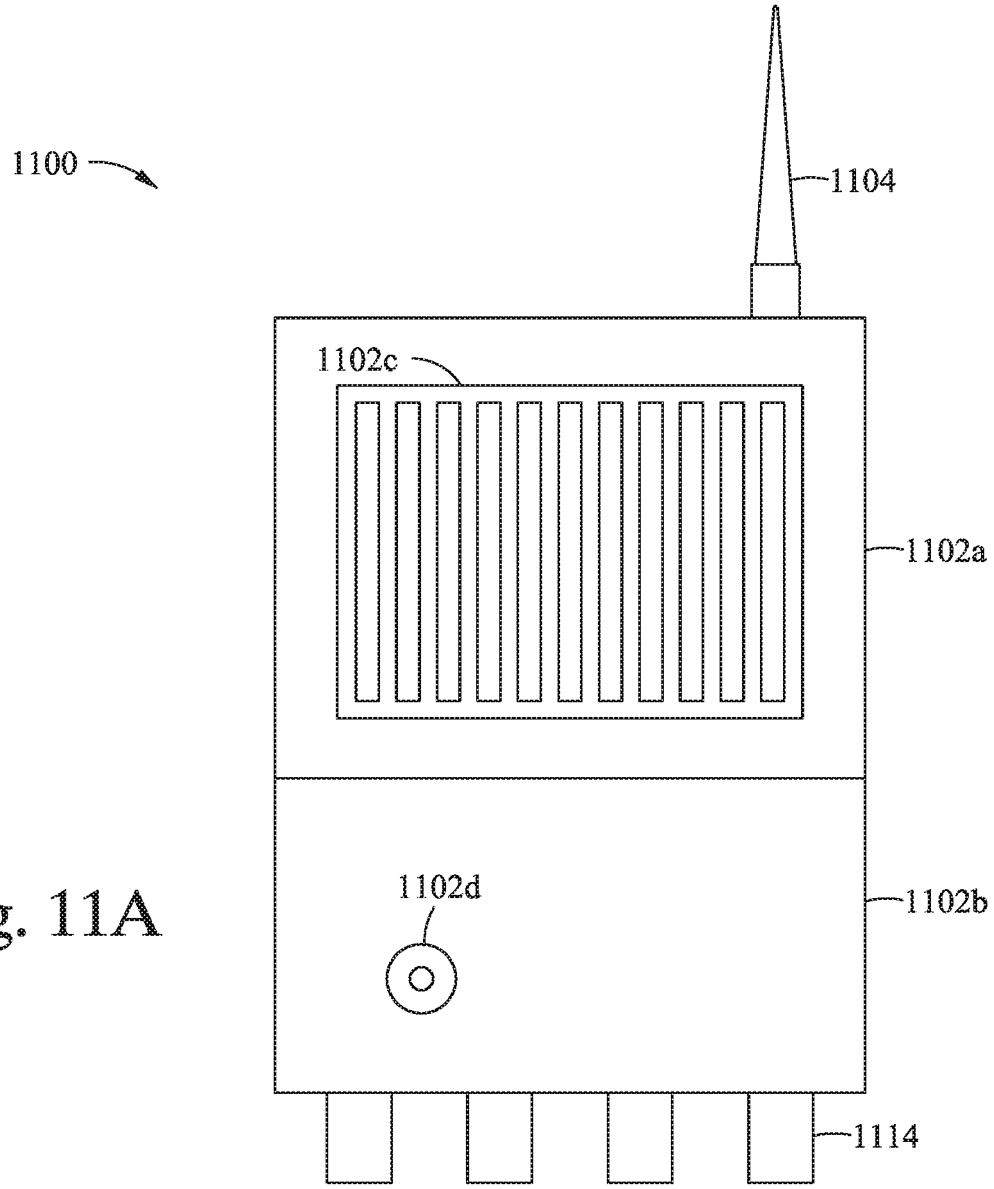
FIGS. 11A-C illustrate a tool mounted controller for a hydrocarbon recovery system, in accordance with embodiments of the present invention.
Figure 11B:
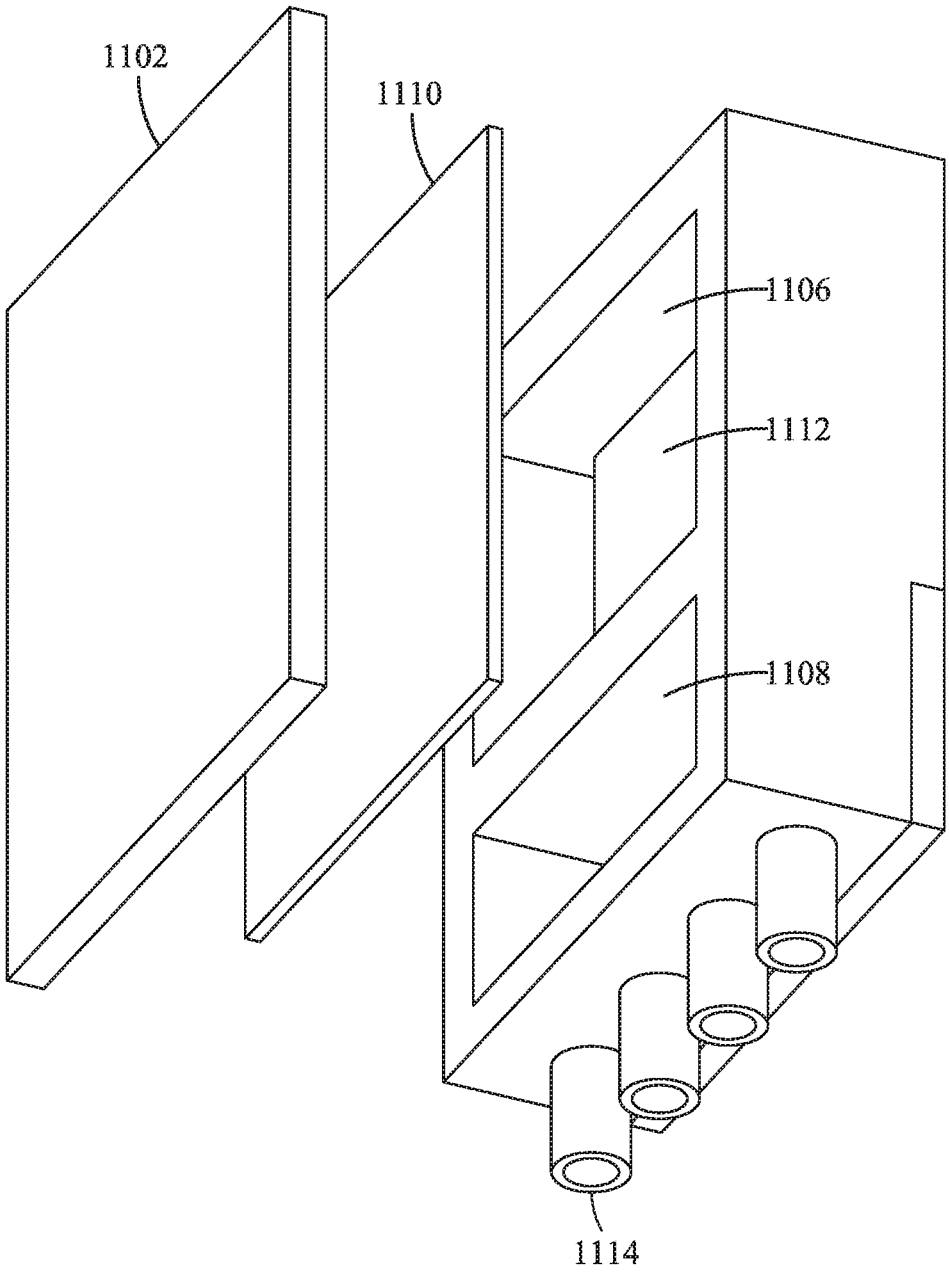
Figure 11C:
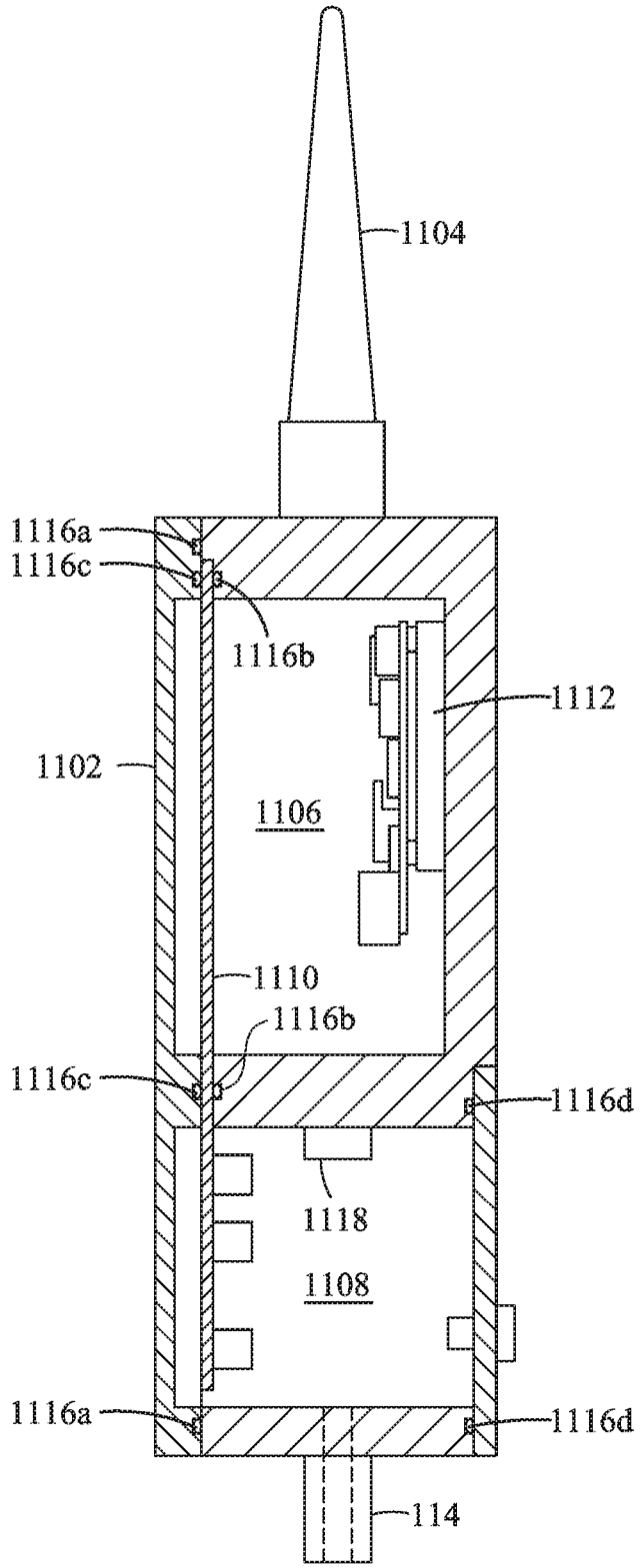

FIGS. 11A-C illustrate a tool mounted controller 1100 for a hydrocarbon recovery system. Tool mounted controller 1100 may include a housing 1102, a wireless antenna 1104, a printed circuit board 1110, a computer processing unit (CPU) 1112, and a plurality of cable connections 1114. The housing 1102 may be mounted directly on a suitable tool for hydrocarbon recovery operations, such as tongs, overdrive systems, elevators, mud buckets, positioning systems, compensators, draw works, top drives, casing making devices, gripping devices, spiders, mud pumps, pickup and laydown tools, interlocks, cement heads, release balls and plugs, control line positioning tools, blowout preventers (BOPs), bails and the like. For example, a tool mounted controller may be mounted to tongs 102*a*, as shown in FIG. 1A.

The housing 1102 may include one or more sections 1102*a*, 1102*b*. Cooling segments 1102*c* may be formed on an outer surface of the section 1102*a*. The cooling segments 1102*c* may be configured to transfer heat away from the housing 1102. The cooling segments 1102*c* may be configured to protect the electronics within housing 1102 from overheating failure. The housing 1102 may be an explosion-proof housing. In some embodiments, housing 1102 may be configured to satisfy explosion-proof standards according to the International Electrotechnical Commission System for Certification to Standards Relating to Equipment for Use in Explosive Atmospheres (IECEx). In some embodiments, housing 1102 may be a flameproof housing. In some embodiments, housing 1102 may be formed from a single mold.

Wireless antenna 1104 may be connected to the housing 1102 at the top of the tool mounted controller 1100. Tool mounted controller 1100 may communicate with a remote controller 106 via wireless antenna 1104. Status indicator 1102*d* may be connected to the housing section 1102*b*. Status indicator 1102*d* may be a light emitting diode (LED). Status indicator 1102*d* may indicate an operational condition of the tool mounted controller 1100.

Housing 1102 may include two or more chambers 1106, 1108. A printed circuit board (PCB) 1110 may extend through the first chamber 1106 and second chamber 1108. The PCB 1110 may be sealed and held in place by O-rings 1116*a-d*. The plurality of O-rings 1116*a-d* may be configured to engage and seal against the PCB 1110. The PCB 1110 may include input/output modules. The input/output modules may be communicatively coupled to the plurality of cable connections 1114. The plurality of cable connections 1114 may be communicatively coupled at an opposite end to components of an associated tool. The plurality of cable connections 1114 may be configured to provide at least one of fluid communication, data, and/or signals between the tool mounted controller 1100 and the associated tool.

First chamber 1106 may include a plurality of electrical components. A central processing unit (CPU) 1112 may be disposed in first chamber 1106. The CPU 1112 may include a storage device and a wireless transmitter configured to communicate with a remote controller. The CPU 1112 may be mounted on a heat sink. The heat sink may be configured to transfer heat from the CPU 1112 to the cooling segments 1102*c*. First chamber 1106 may be filled with a granular material, such as glass powder. The granular material may be configured to protect the plurality of electrical components disposed in first chamber 1106. The granular material may prevent an arc from igniting an explosive atmosphere in the first chamber 1106. First chamber 1106 may be configured to satisfy the IECEx standard 60079-5 and/or standard Ex-q.

Second chamber 1108 may include a breathing gland 1118. Breathing gland 1118 may be configured to permit air flow between the first chamber 1106 and second chamber 1108. Second chamber 1108 may be filled with a desiccant configured to remove moisture from the second chamber 1108. Breathing gland 1118 may permit moisture in the air from first chamber 1106 to flow into second chamber 1108 where the desiccant absorbs the moisture from the air. The plurality of cable connections 1114 may be communicatively coupled to the PCB 1110 in the second chamber 1108.

The first chamber 1106 may be configured to be sealed and unopenable. The second chamber 1108 may include a removable front panel. The front panel may be connected to the housing 1102 with a plurality of fasteners. The removable front panel may allow an operator to access the second chamber 1108. For example, the front panel may be removed to allow spent desiccant to be replaced.

In some embodiments, tool mounted controller 1100 may be disposed in a flameproof enclosure. In some embodiments, first chamber 1106 may be a flameproof enclosure. For example, first chamber 1106 may be configured to satisfy flameproof standards according to the International Electrotechnical Commission System for Certification to Standards Relating to Equipment for Use in Explosive Atmospheres (IECEx). First chamber 1106 may be configured to satisfy the IECEx standard 60079-1 and/or standard Ex-d. In some embodiments, housing 1102 may be a molded enclosure configured to satisfy molded standards according to IECEx.

Figure 12A:
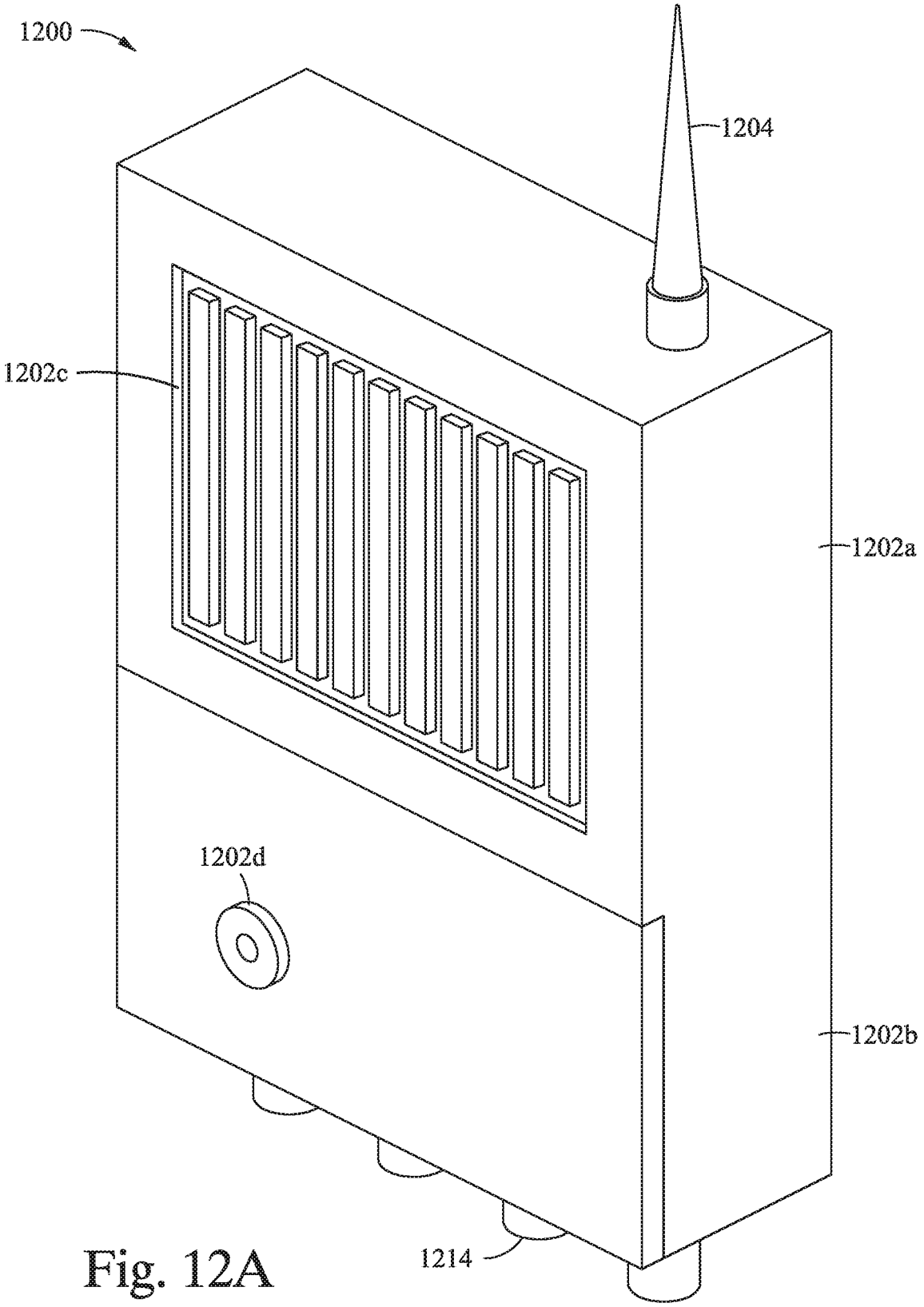
FIGS. 12A-B illustrate a tool mounted controller for a hydrocarbon recovery system, in accordance with embodiments of the present invention.
Figure 12B:
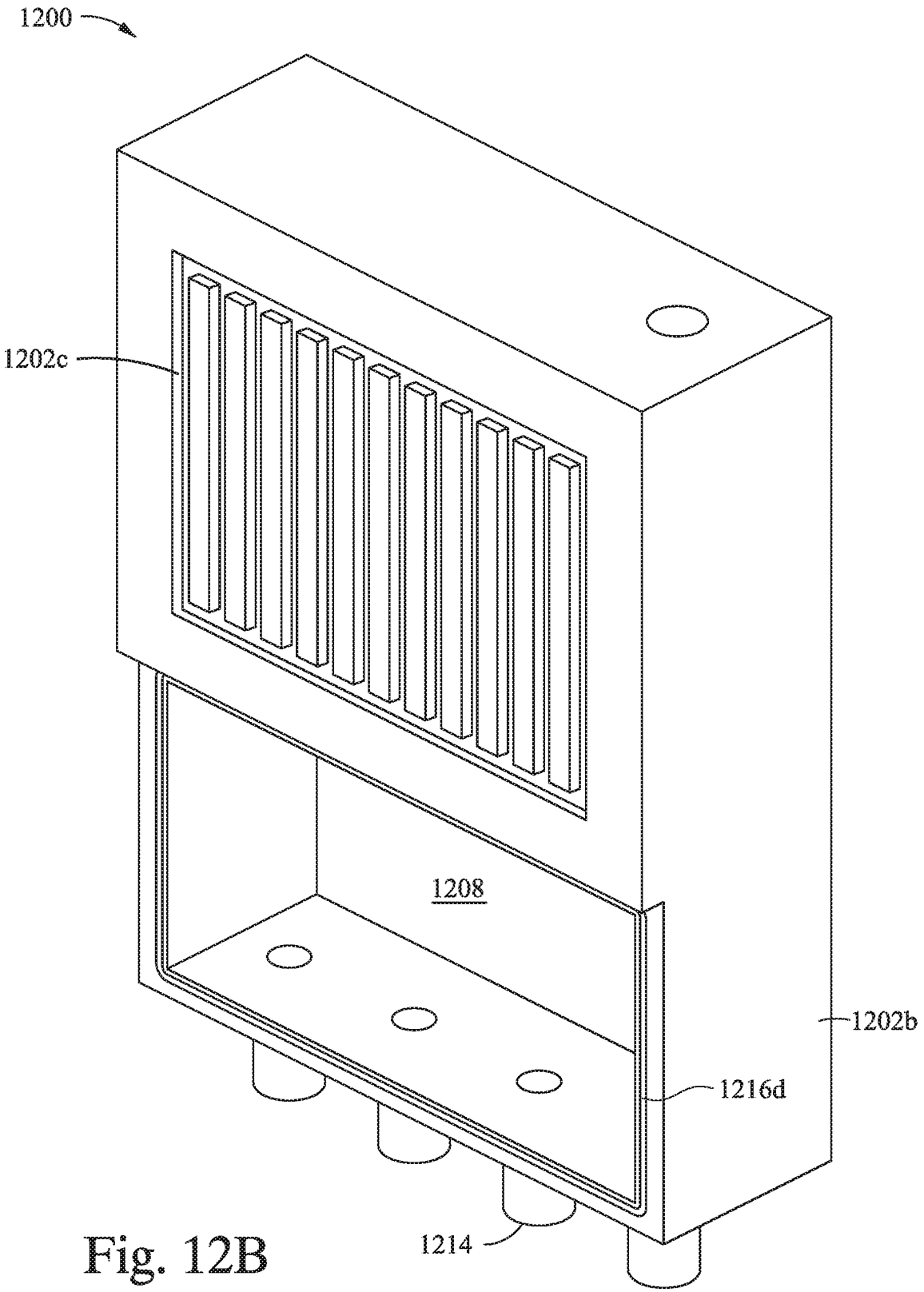

FIGS. 12A-B illustrate a tool mounted controller 1200 for a hydrocarbon recovery system. Tool mounted controller 1200 may be similar to tool mounted controller 1100. Tool mounted controller 1200 may include a housing 1202, a wireless antenna 1204, a printed circuit board, a computer processing unit (CPU), and a plurality of cable connections 1214. The housing 1202 may be mounted directly on a suitable tool for hydrocarbon recovery operations, such as tongs, overdrive systems, elevators, mud buckets, positioning systems, compensators, draw works, top drives, casing making devices, gripping devices, spiders, mud pumps, pickup and laydown tools, interlocks, cement heads, release balls and plugs, control line positioning tools, blowout preventers (BOPs), bails and the like. For example, a tool mounted controller may be mounted to tongs 202*a* and positioning arm 202*b*, as shown in FIG. 2A.

The housing 1202 may include one or more sections 1202*a*, 1202*b*. Cooling segments 1202*c* may be formed on an outer surface of the section 1202*a*. The cooling segments 1202*c* may be configured to transfer heat away from the housing 1202. The cooling segments 1202*c* may be configured to protect the electronics within housing 1202 from overheating failure. The housing 1202 may be an explosion-proof housing. In some embodiments, housing 1202 may be configured to satisfy explosion-proof standards according to the International Electrotechnical Commission System for Certification to Standards Relating to Equipment for Use in Explosive Atmospheres (IECEx). In some embodiments, housing 1202 may be a flameproof housing. In some embodiments, housing 1202 may be formed from a single mold.

Wireless antenna 1204 may be connected to the housing 1202 at the top of the tool mounted controller 1200. Tool mounted controller 1200 may communicate with a remote controller 106 via wireless antenna 1204. Status indicator 1202*d* may be connected to the housing section 1202*b*. Status indicator 1202*d* may be a light emitting diode (LED). Status indicator 1202*d* may indicate an operational condition of the tool mounted controller 1200.

Housing 1202 may include two or more chambers. A printed circuit board (PCB) may extend through the first chamber and second chamber 1208. The PCB may be sealed and held in place by O-rings (e.g., O-ring 1216*d*). The PCB may include input/output modules. The input/output modules may be communicatively coupled to the plurality of cable connections 1214. The plurality of cable connections 1214 may be communicatively coupled at an opposite end to components of an associated tool. The plurality of cable connections 1214 may be configured to provide at least one of fluid communication, data, and/or signals between the tool mounted controller 1200 and the associated tool.

First chamber may include a plurality of electrical components. A central processing unit (CPU) may be disposed in first chamber. The CPU may include a storage device and a wireless transmitter configured to communicate with a remote controller. The CPU may be mounted on a heat sink. The heat sink may transfer heat from the CPU to the cooling segments 1202*c*. First chamber may be filled with a granular material, such as glass powder. The granular material may be configured to protect the plurality of electrical components disposed in first chamber. The granular material may prevent an arc from igniting an explosive atmosphere in the first chamber. First chamber may be configured to satisfy the IECEx standard 60079-5 and/or standard Ex-q.

Second chamber 1208 may include a breathing gland. Breathing gland may be configured to permit air flow between the first chamber and second chamber 1208. Second chamber 1208 may be filled with a desiccant configured to remove moisture from the second chamber 1208. Breathing gland may permit moisture in the air from first chamber to flow into second chamber 1208 where the desiccant absorbs the moisture from the air. The plurality of cable connections 1214 may be communicatively coupled to the PCB in the second chamber 1208.

The first chamber 1206 may be configured to be sealed and unopenable. The second chamber 1208 may include a removable front panel. The front panel may be connected to the housing 1202 with a plurality of fasteners. The removable front panel may allow an operator to access the second chamber 1208. For example, the front panel may be removed to allow spent desiccant to be replaced.

In some embodiments, tool mounted controller 1200 may be disposed in a flameproof enclosure. In some embodiments, first chamber may be a flameproof enclosure. For example, first chamber may be configured to satisfy flameproof standards according to the International Electrotechnical Commission System for Certification to Standards Relating to Equipment for Use in Explosive Atmospheres (IECEx). First chamber may be configured to satisfy the IECEx standard 60079-1 and/or standard Ex-d.

In one or more of the embodiments described herein, a hydrocarbon recovery system generally includes a first tool, a remote controller, and a first control device mounted on the first tool and communicatively coupled to the remote controller.

In one or more of the embodiments described herein, the first control device is configured to receive a command to operate the first tool from the remote controller; based on the command, generate one or more instructions executable by the first control device; and execute the one or more instructions to operate the first tool.

In one or more of the embodiments described herein, the hydrocarbon recovery system includes a second tool and a second control device mounted on the second tool and communicatively coupled to the remote controller.

In one or more of the embodiments described herein, the second control device is configured to receive a command to operate a second tool from the remote controller; based on the command, generate one or more instructions executable by the second control device; and execute the one or more instructions to operate the second tool.

In one or more of the embodiments described herein, the first control device includes a data transceiver, a processor, and an input/output interface.

In one or more of the embodiments described herein, the processor is configured to receive, via the data transceiver, a first command to operate the first tool; and generate one or more second commands executable by the first control device based on the first command.

In one or more of the embodiments described herein, the input/output interface is configured to operate the first tool based on the one or more second commands.

In one or more of the embodiments described herein, the second control device includes a data transceiver, a processor, and an input/output interface.

In one or more of the embodiments described herein, the processor is configured to receive, via the data transceiver, a first command to operate the second tool; and generate one or more second commands executable by the second control device based on the first command.

In one or more of the embodiments described herein, the input/output interface is configured to operate the second tool based on the one or more second commands.

In one or more of the embodiments described herein, the first control device is configured to store screen content related to operation of the first tool; and transmit the screen content to the remote controller for display.

In one or more of the embodiments described herein, the screen content includes one or more menu screens related to operation of the first tool.

In one or more of the embodiments described herein, the second control device is configured to store screen content related to operation of the second tool; and transmit the screen content to the remote controller for display.

In one or more of the embodiments described herein, the screen content includes one or more menu screens related to operation of the second tool.

In one or more of the embodiments described herein, the first control device is configured to receive a command to operate the first tool from the remote controller via a wireless interface.

In one or more of the embodiments described herein, the second control device is configured to receive a command to operate the second tool from the remote controller via a wireless interface.

In one or more of the embodiments described herein, the first control device includes one or more fluid power units in fluid communication with the first tool and the processor is configured to actuate at least one of the one of more fluid power units in response to the first command.

In one or more of the embodiments described herein, the second control device includes one or more fluid power units in fluid communication with the second tool and the processor is configured to actuate at least one of the one of more fluid power units in response to the first command.

In one or more of the embodiments described herein, a method for hydrocarbon recovery includes receiving, at a first control device mounted to a first tool, one or more commands related to operation of a first tool; based on the received command, generating one or more commands executable by the first control device; and executing the one or more commands to operate the first tool.

In one or more of the embodiments described herein, the method further includes receiving, at a second control device mounted to a second tool, one or more commands related to operation of a second tool; based on the received command, generating one or more commands executable by the second control device; and executing the one or more commands to operate the second tool.

In one or more of the embodiments described herein, the method further includes transmitting, from the first control device, one or more screens associated with the first tool, the one or more screens including one or more options for operating the first tool; and wherein the received command comprises a command to operate the first tool using parameters for the first tool modified on one of the one or more screens.

In one or more of the embodiments described herein, the method further includes transmitting, from the second control device, one or more screens associated with the second tool, the one or more screens including one or more options for operating the second tool; and wherein the received command comprises a command to operate the second tool using parameters for the second tool modified on one of the one or more screens.

In one or more of the embodiments described herein, generating one or more commands includes generating one or more electronic instructions to command operation of the first tool; and triggering actuation of one or more fluid power devices in fluid communication with the first tool to modify one or more operating parameters of the first tool.

In one or more of the embodiments described herein, generating one or more commands includes generating one or more electronic instructions to command operation of the second tool; and triggering actuation of one or more fluid power devices in fluid communication with the second tool to modify one or more operating parameters of the second tool.

In one or more of the embodiments described herein, a non-transitory computer readable medium includes instructions that, when executed by one or more processors, executes a method for hydrocarbon recovery, the method including receiving, at a first control device mounted on a first tool, one or more commands related to operation of the first tool; based on the received command, generating one or more commands executable by the first control device; and executing the one or more commands to operate the first tool.

In one or more of the embodiments described herein, the method further includes receiving, at a second control device mounted on a second tool, one or more commands related to operation of the second tool; based on the received command, generating one or more commands executable by the second control device; and executing the one or more commands to operate the second tool.

In one or more of the embodiments described herein, the method further includes transmitting, from the first control device, one or more screens associated with the first tool, the one or more screens including one or more options for operating the first tool; and wherein the received command comprises a command to operate the first tool using parameters for the first tool modified on one of the one or more screens.

In one or more of the embodiments described herein, the method further includes transmitting, from the second control device, one or more screens associated with the second tool, the one or more screens including one or more options for operating the second tool; and wherein the received command comprises a command to operate the second tool using parameters for the second tool modified on one of the one or more screens.

In one or more of the embodiments described herein, a hydrocarbon recovery system generally includes a first tool and a first control device mounted on the first tool and configured to operate the first tool.

In one or more of the embodiments described herein, the first control device includes an explosion-proof housing and a processor disposed in the housing.

In one or more of the embodiments described herein, the first control device includes a wireless antenna connected to the housing, the wireless antenna configured to communicate with a remote controller.

In one or more of the embodiments described herein, the hydrocarbon recovery system generally includes a second tool and a second control device mounted on the second tool.

In one or more of the embodiments described herein, the second control device is configured to operate the second tool.

In one or more of the embodiments described herein, the second control device includes an explosion-proof housing and a processor disposed in the housing.

In one or more of the embodiments described herein, the second control device includes a wireless antenna connected to the housing, the wireless antenna configured to communicate with a remote controller.

In one or more of the embodiments described herein, the first control device includes a status indicator configured to indicate an operation condition of the first control device.

In one or more of the embodiments described herein, the housing of the first control device includes a first chamber, wherein the first chamber contains a granular material.

In one or more of the embodiments described herein, the housing of the first control device includes a second chamber.

In one or more of the embodiments described herein, the second chamber contains a desiccant configured to remove moisture from the second chamber.

In one or more of the embodiments described herein, the first control device includes a plurality of seals configured to engage and seal against the circuit board.

In one or more of the embodiments described herein, the first control device includes a circuit board disposed in the housing and extending through the first chamber and the second chamber.

In one or more of the embodiments described herein, the housing includes a breathing gland disposed between the first chamber and the second chamber and configured to permit air flow between the first chamber and the second chamber.

In one or more of the embodiments described herein, the first control device includes a plurality of cable connections configured to provide at least one of fluid communication, data, and signals between the first control device and the first tool.

In one or more of the embodiments described herein, the second control device includes a plurality of cable connections configured to provide at least one of fluid communication, data, and signals between the second control device and the second tool.

In one or more of the embodiments described herein, the housing includes cooling segments configured to transfer heat away from the housing.

In one or more of the embodiments described herein, wherein the wireless antenna is configured to communicate with the first control device.

In one or more of the embodiments described herein, wherein the processor is mounted on a heat sink.

In one or more of the embodiments described herein, wherein the housing is a flameproof housing.

In one or more of the embodiments described herein, wherein the first tool is a tong.

In one or more of the embodiments described herein, wherein the first tool is a tong and the second tool is a positioning arm connected to the tong.

In one or more of the embodiments described herein, the second chamber includes a removable front panel.

In one or more of the embodiments described herein, the first chamber is configured to be unopenable.

While the foregoing is directed to embodiments of the present invention, other and further embodiments of the invention may be devised without departing from the basic scope thereof, and the scope thereof is determined by the claims that follow.

The invention claimed is:

1. A tubular handling system, comprising:
- a first tool; and
- a first control device mounted on the first tool and configured to operate the first tool, the first control device comprising:
  - an explosion-proof housing comprising:
    - a first chamber configured to be unopenable, wherein the first chamber contains a granular material; and
    - a second chamber;
  - a processor disposed in the housing; and
  - a circuit board disposed in the housing and extending through the first chamber and the second chamber.

2. The tubular handling system of claim 1, the first control device further comprising a wireless antenna connected to the housing, the wireless antenna configured to communicate with a remote controller.

3. The tubular handling system of claim 1, further comprising:
- a second tool; and
- a second control device mounted on the second tool and configured to operate the second tool, the second control device comprising:
  - a second explosion-proof housing; and
  - a second processor disposed in the second explosion-proof housing.

4. The tubular handling system of claim 3, wherein:
- the first tool is a tong; and
- the second tool is a positioning arm connected to the tong.

5. The tubular handling system of claim 1, the first control device further comprises a status indicator configured to indicate an operation condition of the first control device.

6. The tubular handling system of claim 1, wherein the second chamber contains a desiccant configured to remove moisture from the second chamber.

7. The tubular handling system of claim 1, wherein the second chamber comprises a removable front panel.

8. The tubular handling system of claim 1, the first control device further comprising a plurality of seals configured to engage and seal against the circuit board.

9. The tubular handling system of claim 1, wherein the first control device further includes a breathing gland disposed between the first chamber and the second chamber and configured to permit air flow between the first chamber and the second chamber.

10. The tubular handling system of claim 1, the first control device further comprising a plurality of cable connections configured to provide at least one of fluid communication, data, and signals between the first control device and the first tool.

11. The tubular handling system of claim 1, the housing further comprising cooling segments configured to transfer heat away from the housing.

12. The tubular handling system of claim 1, wherein the processor is mounted on a heat sink.

13. The tubular handling system of claim 1, wherein the housing is a flameproof housing.

14. A control device mountable to a tool, comprising:
a housing, comprising:
a first chamber configured to be unopenable; and
a second chamber;
a granular material disposed in the first chamber;
a desiccant disposed in the second chamber to remove moisture from the second chamber;
a breathing gland disposed between the first chamber and the second chamber and configured to permit air flow between the first chamber and the second chamber;
a processor disposed in the housing;
a circuit board disposed in the housing and extending through the first chamber and the second chamber; and
a plurality of seals configured to engage and seal against the circuit board.

15. A control device mountable to a tool, comprising:
a housing, comprising:
a first chamber; and
a second chamber;
a processor disposed in the housing;
a circuit board disposed in the housing and extending through the first chamber and the second chamber; and
a plurality of seals configured to engage and seal against the circuit board.

16. The control device of claim 15, wherein the control device is configured to be unopenable.

17. The control device of claim 15, further comprising:
a granular material disposed in the first chamber;
a desiccant disposed in the second chamber to remove moisture from the second chamber; and
a breathing gland disposed between the first chamber and the second chamber and configured to permit air flow between the first chamber and the second chamber.

18. A tubular handling system, comprising:
a first tool;
a second tool; and
a first control device mounted on the first tool and configured to operate the first tool, the first control device comprising:
a first explosion-proof housing comprising:
a first chamber configured to be unopenable; and
a second chamber;
a first processor disposed in the first explosion-proof housing; and
a circuit board disposed in the first explosion-proof housing and extending through the first chamber and the second chamber; and
a second control device mounted on the second tool and configured to operate the second tool, the second control device comprising:
a second explosion-proof housing; and
a second processor disposed in the second explosion-proof housing.

19. A tubular handling system, comprising:
a first tool; and
a first control device mounted on the first tool and configured to operate the first tool, the first control device comprising:
an explosion-proof housing comprising:
a first chamber configured to be unopenable; and
a second chamber;
a processor disposed in the housing;
a circuit board disposed in the housing and extending through the first chamber and the second chamber; and
a plurality of seals configured to engage and seal against the circuit board.

20. A tubular handling system, comprising:
a first tool; and
a first control device mounted on the first tool and configured to operate the first tool, the first control device comprising:
an explosion-proof housing comprising:
a first chamber configured to be unopenable; and
a second chamber;
a breathing gland disposed between the first chamber and the second chamber and configured to permit air flow between the first chamber and the second chamber;
a processor disposed in the housing; and
a circuit board disposed in the housing and extending through the first chamber and the second chamber.

21. A control device mountable to a tool, comprising:
a housing, comprising:
a first chamber; and
a second chamber;
a processor disposed in the housing;
a granular material disposed in the first chamber;
a desiccant disposed in the second chamber to remove moisture from the second chamber;
a breathing gland disposed between the first chamber and the second chamber and configured to permit air flow between the first chamber and the second chamber; and
a circuit board disposed in the housing and extending through the first chamber and the second chamber.

* * * * *